US010238173B2

(12) United States Patent
Ngene

(10) Patent No.: US 10,238,173 B2
(45) Date of Patent: Mar. 26, 2019

(54) ARTICLE OF FOOTWEAR FOR WEIGHTLIFTING

(71) Applicant: NIKE, Inc., Beaverton, OR (US)

(72) Inventor: David Ngene, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 12 days.

(21) Appl. No.: 15/593,818

(22) Filed: May 12, 2017

(65) Prior Publication Data

US 2017/0325544 A1 Nov. 16, 2017

Related U.S. Application Data

(60) Provisional application No. 62/336,251, filed on May 13, 2016.

(51) Int. Cl.

| | |
|---|---|
| ***A43B 7/08*** | (2006.01) |
| ***A43B 13/18*** | (2006.01) |
| ***A43B 21/26*** | (2006.01) |
| ***A43B 5/00*** | (2006.01) |
| ***A43B 13/04*** | (2006.01) |
| ***A43B 13/14*** | (2006.01) |
| ***A43B 13/12*** | (2006.01) |
| ***A43B 23/17*** | (2006.01) |

(52) U.S. Cl.

CPC ..... *A43B 13/186* (2013.01); *A43B 5/00* (2013.01); *A43B 7/08* (2013.01); *A43B 7/087* (2013.01); *A43B 13/04* (2013.01); *A43B 13/125* (2013.01); *A43B 13/14* (2013.01); *A43B 13/141* (2013.01); *A43B 13/148* (2013.01); *A43B 13/181* (2013.01); *A43B 21/26* (2013.01); *A43B 23/17* (2013.01)

(58) Field of Classification Search

CPC .. A43B 7/144; A43B 9/14; A43B 5/00; A43B 21/26; A43B 7/06; A43B 7/08; A43B 7/087

USPC ..... 36/25 R, 114, 30 R, 35 R, 37, 3 R, 3 B, 36/31

See application file for complete search history.

(56) References Cited

U.S. PATENT DOCUMENTS

| | | | | | |
|---|---|---|---|---|---|
| 2,292,318 | A * | 8/1942 | Daly | A43B 7/06 | 36/3 B |
| 4,438,573 | A * | 3/1984 | McBarron | A43B 7/081 | 36/3 B |
| 4,878,300 | A | 11/1989 | Bogaty | | |
| 5,896,678 | A * | 4/1999 | Ganon | A43B 3/108 | 36/11.5 |
| 6,041,523 | A * | 3/2000 | Deloreia | A43B 7/38 | 36/172 |

(Continued)

*Primary Examiner* — Marie D Bays

(74) *Attorney, Agent, or Firm* — Quinn IP Law

(57) ABSTRACT

A sole structure for an article of footwear comprises a base component and a wedge component. The base component has a forefoot region, a midfoot region, and a heel region, and includes a forward base portion and a rearward base portion. The forward base portion of the base component includes a forward lateral flange and a forward medial flange. The wedge component extends from the midfoot region to the heel region and includes a forward portion having a rearward medial flange and a rearward lateral flange. The forward lateral flange of the base component abuts the rearward lateral flange of the wedge component. The forward medial flange of the base component abuts the rearward medial flange of the wedge component.

18 Claims, 12 Drawing Sheets

(56) References Cited

U.S. PATENT DOCUMENTS

| | | | | |
|---|---|---|---|---|
| 6,769,202 | B1 * | 8/2004 | Luthi | A43B 13/184 36/28 |
| 8,336,230 | B2 * | 12/2012 | Crowley | A43B 5/00 36/105 |
| 2006/0042120 | A1 | 3/2006 | Sokolowski et al. | |
| 2006/0156579 | A1 | 7/2006 | Hoffer et al. | |
| 2006/0191163 | A1 * | 8/2006 | Nakano | A43B 7/144 36/30 R |
| 2006/0201028 | A1 * | 9/2006 | Chan | A43B 7/142 36/28 |
| 2007/0022628 | A1 * | 2/2007 | Juan | A43B 7/06 36/3 B |
| 2008/0127522 | A1 * | 6/2008 | Crowley | A43B 5/00 36/105 |
| 2010/0236096 | A1 * | 9/2010 | Pauk | A43B 13/12 36/28 |
| 2011/0225852 | A1 | 9/2011 | Mahoney | |
| 2012/0060395 | A1 * | 3/2012 | Blevens | A43B 1/0072 36/30 R |
| 2013/0081305 | A1 * | 4/2013 | Byrne | A43B 13/122 36/31 |
| 2014/0101972 | A1 | 4/2014 | Ha | |
| 2015/0033581 | A1 | 2/2015 | Barnes et al. | |
| 2015/0157088 | A1 | 6/2015 | Seo | |
| 2015/0342300 | A1 | 12/2015 | Cin et al. | |
| 2016/0058122 | A1 | 3/2016 | Foxen | |

* cited by examiner

ARTICLE OF FOOTWEAR FOR WEIGHTLIFTING

CROSS-REFERENCE TO RELATED APPLICATIONS

This application claims the benefit of priority to U.S. Provisional Application No. 62/336,251, filed May 13, 2016, which is hereby incorporated by reference in its entirety.

TECHNICAL FIELD

The present embodiments relate generally to sole structures for articles of footwear and, in particular, for use in articles of footwear associated with weightlifting-related activities.

BACKGROUND

Articles of footwear generally include two primary elements: an upper and a sole structure. The upper is often formed from a plurality of material elements (e.g., textiles, polymer sheet layers, foam layers, leather, synthetic leather) that are stitched or adhesively bonded together to form a void on the interior of the footwear for comfortably and securely receiving a foot. More particularly, the upper forms a structure that extends over instep and toe areas of the foot, along medial and lateral sides of the foot, and around a heel area of the foot. The upper may also incorporate a lacing system to adjust the fit of the footwear, as well as permitting entry and removal of the foot from the void within the upper. Likewise, some articles of apparel may include various kinds of closure systems for adjusting the fit of the apparel.

BRIEF DESCRIPTION OF THE DRAWINGS

The embodiments can be better understood with reference to the following drawings and description. The components in the figures are not necessarily to scale unless noted otherwise, emphasis instead being placed upon illustrating the principles of the embodiments. Moreover, in the figures, like reference numerals designate corresponding parts throughout the different views.

DETAILED DESCRIPTION

Figure 1:
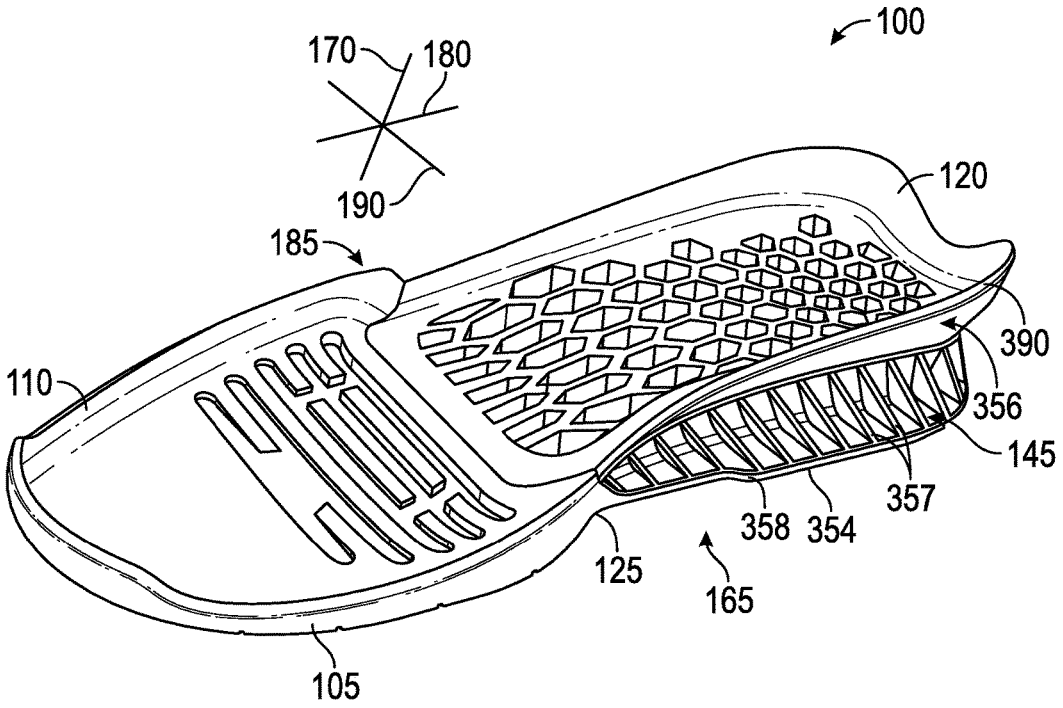
FIG. 1 is an isometric medial view of an embodiment of a sole structure.

A sole structure for an article of footwear comprises a base component and a wedge component. The base component has a forefoot region, a midfoot region, and a heel region, and includes a forward base portion and a rearward base portion. The forward base portion of the base component includes a forward lateral flange and a forward medial flange. The wedge component extends from the midfoot region to the heel region and includes a forward portion having a rearward medial flange and a rearward lateral flange. The forward lateral flange of the base component abuts the rearward lateral flange of the wedge component. The forward medial flange of the base component abuts the rearward medial flange of the wedge component.

In one or more embodiments, the base component may be more compressible than the wedge component, the base component may be more flexible than the wedge component, or both. The forward base portion of the base component may be thicker than the rearward base portion of the base component.

In one or more embodiments, the wedge component may include a tongue, and the base component may include a recessed intermediate portion extending between the forward lateral flange and the medial lateral flange. The tongue overlies and abuts the recessed intermediate portion between the forward lateral flange and the rearward lateral flange.

In one or more embodiments, the rearward portion may include a first set of through-holes extending from a proximal surface of the base component to a distal surface of the base component, and the wedge component may include a second set of through-holes that are aligned with the first set of through-holes.

In one or more embodiments, distal surfaces of each of the rearward lateral flange and the rearward medial flange of the wedge component may slope downwardly and inwardly toward a central region of a base portion of the wedge component. Additionally, multiple support fins may be arranged at each of the medial and lateral sides of the wedge component. Each of the multiple support fins may be coupled with an upper surface of the base portion of the wedge component, and may further extend upwardly and inwardly toward a sloped distal surface of one or the other of the rearward lateral flange and the rearward medial flange.

In one or more embodiments, at least one of the multiple support fins may have an exposed edge that slopes downwardly and outwardly from proximate the sloped distal surface of one or the other of the rearward lateral flange and the rearward medial flange toward a peripheral edge of the base portion of the wedge component, forming an angular brace between the base portion of the wedge component and an upwardly and outwardly sloping distal surface of the wedge component adjacent the one or the other of the rearward lateral flange and the rearward medial flange.

In one or more embodiments, each of the multiple support fins may be substantially uniformly spaced apart from each other adjacent ones of the multiple support fins along either or both of a lateral side and a medial side of the wedge component.

In one or more embodiments, a forward facing surface of each of two or more of the multiple support fins may be parallel-planar relative to a rearward facing surface of an adjacent one of the multiple support fins.

In one or more embodiments, at least some of the multiple support fins may have an upper extent and a lower extent, with the upper extent located more forwardly than the lower extent such that said at least some of the multiple support fins angle forwardly.

In one or more embodiments, the sole structure may further comprise one or more additional support fins disposed rearwardly of the multiple support fins and proximate a heel portion of the wedge component.

In one or more embodiments, one or more of the additional support fins may each have a planar lateral surface and an opposing planar medial surface both extending substantially vertically from the base portion of the wedge component.

In one or more embodiments, at least one of the first set of through-holes and the second set of through-holes may include a forwardmost through-hole and a rearmost through-hole. The forwardmost through-hole may be more elongate along a longitudinal axis of the sole structure than the rearmost through-hole. As used herein, a feature is more elongate than another feature along an axis when it extends further along the axis than the other feature.

In one or more embodiments, through-holes of one or both of the first set of through-holes and the second set of through-holes may be arranged in two or more rows. The through-holes of each row of through-holes may be arranged transversely across a portion of the sole structure, and the two or more rows may be distributed along a longitudinal axis of the sole structure with a forwardmost row and a rearmost row.

In one or more embodiments, the through-holes of at least a first row of the two or more rows of through-holes may be offset transversely from the through-holes of at least a second row of the two or more rows of through-holes, such that a vertical plane extending along the longitudinal axis of the sole structure and bisecting a through-hole of the first row passes between two adjacent through-holes of the second row of through-holes.

In one or more embodiments, the sole structure may include a rim extending around a perimeter of a through-hole of the second set of through-holes at a distalmost end of the through-hole. A portion of the rim may project inwardly toward an axial center of the through-hole.

In one or more embodiments, a portion of the rim may project downwardly beyond a distal surface of the wedge component and may be dimensioned and shaped to be received within a proximal opening of a corresponding through-hole of the first set of through-holes.

An article of footwear may comprise a base component having a forefoot region, a midfoot region, and a heel region. The base component may have a forward base portion and a rearward base portion, and a sloped proximal surface at which the base component decreases in height from the forward base portion to the rearward base portion. The article of footwear may further comprise a wedge component overlying the rearward base portion and tapering in height from a rear extent of the wedge component to a foremost extent of the wedge component. The wedge component may include a tongue at the foremost extent. The tongue may have a sloped distal surface that abuts and is coextensive with the sloped proximal surface of the base component.

In one or more embodiments, the through-holes of at least a first row of the two or more rows of through-holes may be offset transversely from the through-holes of at least a second row of the two or more rows of through-holes, such that a vertical plane extending along the longitudinal axis of the sole structure and bisecting a through-hole of the first row passes between two adjacent through-holes of the second row of through-holes.

In one or more embodiments, the through-holes of at least a first row of the two or more rows of through-holes may be offset transversely from the through-holes of at least a second row of the two or more rows of through-holes, such that a vertical plane extending along the longitudinal axis of the sole structure and bisecting a through-hole of the first row passes between two adjacent through-holes of the second row of through-holes.

In one or more embodiments, the base component may have a medial shoulder and a lateral shoulder each of which protrudes inward adjacent the sloped proximal surface. The tongue may be nested between the medial shoulder and the lateral shoulder.

In one or more embodiments, a sole structure for an article of footwear includes a forefoot region, a midfoot region, a heel region, a medial side, and a lateral side. The sole structure comprises a bottom component and a wedge component. The bottom component extends from the forefoot region to the heel region. The bottom component comprises a forward base portion and a rearward base portion. The forward base portion of the bottom component includes a forward lateral flange and a forward medial flange. The wedge component extends from the midfoot region to the heel region. A forward portion of the wedge component includes a rearward medial flange and a rearward lateral flange. The forward lateral flange of the bottom component abuts the rearward lateral flange of the wedge component. The forward medial flange of the bottom component abuts the rearward medial flange of the wedge component.

In one or more embodiments, the bottom component is more compressible than the wedge component, the bottom component is more flexible than the wedge component, and/or the forward base portion of the bottom component is thicker than the rearward base portion of the bottom component.

In one or more embodiments, the bottom component includes a tongue portion. A recessed intermediate portion extends between the forward lateral flange and the medial lateral flange. The intermediate portion abuts the tongue portion.

In one or more embodiments, the rearward portion includes a first set of through-holes extending from a proximal surface of the bottom component to a distal surface of the bottom component.

In one or more embodiments, the wedge component includes a second set of through-holes that are aligned with the first set of through-holes.

In one or more embodiments, distal surfaces of each of the rearward lateral flange and the rearward medial flange of the wedge component slope downwardly and inwardly toward a central region of a planar base portion of the wedge component.

In one or more embodiments, the sole structure further comprises plural support fins arranged at each of the medial and lateral sides of the wedge component. Each of the plural support fins is coupled with an upper surface of the wedge component planar base portion, and further extends upwardly and inwardly toward a sloped distal surface of one or the other of the rearward lateral flange and the rearward medial flange.

In one or more embodiments, an exposed edge of one or more of the plural support fins slopes downwardly and outwardly from proximate the sloped distal surface of one or the other of the rearward lateral flange and the rearward medial flange toward a peripheral edge of the planar base portion of the wedge, forming an angular brace between the planar base portion and an upwardly and outwardly sloping distal surface of the wedge component adjacent the one or the other of the rearward lateral flange and the rearward medial flange.

In one or more embodiments, each of the plural support fins is substantially uniformly spaced apart from each other adjacent ones of the plural support fins along either or both of a lateral side and a medial side of the wedge component.

In one or more embodiments, a forward facing surface of each of two or more of the plural support fins is parallel-planar relative to a rearward facing surface of an adjacent one of the plural support fins.

In one or more embodiments, each of the plural support fins is angled forwardly such that an upper extent of each support fin is located more forwardly than its lower extent.

In one or more embodiments, the sole structure further comprises one or more additional support fins disposed rearwardly of the plural support fins and proximate a heel portion of the wedge component.

In one or more embodiments, one or more of the additional support fins each have a planar lateral surface and an opposing planar medial surface both extending substantially vertically from the planar base portion of the wedge component.

In one or more embodiments, a forwardmost through-hole of one or both of the first set of through-holes and the second set of through-holes is more elongate along an anterior-posterior axis of the sole structure than is a corresponding rearmost through-hole of the one or both of the first set of through-holes and the second set of through-holes.

In one or more embodiments, the through-holes of one or both of the first set of through-holes and the second set of through-holes are arranged in two or more rows. The through-holes of each row of through-holes are arranged transversely across a portion of the sole structure, and the two or more rows are distributed along a longitudinal axis of the sole structure with a forwardmost row and a rearmost row.

In one or more embodiments, a distalmost end of one or more through-holes of the second set of through-holes includes a rim extending around the circumference of the through-hole.

In one or more embodiments, a portion of the rim projects inwardly toward an axial center of the through-hole.

In one or more embodiments, a portion of the rim projects downwardly beyond a distal surface of the wedge component.

In one or more embodiments, the portion of the rim that projects downwardly beyond the distal surface of the wedge component is dimensioned and shaped to be received within a proximal opening of a corresponding through-hole of the first set of through-holes.

In one or more embodiments, the through-holes of at least a first row of the two or more rows of through-holes are offset transversely from the through-holes of at least a second row of the two or more rows of through-holes, such that a vertical plane extending along the longitudinal axis of the sole structure and bisecting a through-hole of the first row passes between two adjacent holes of the second row of through-holes.

Any feature, part, component, method step, function or operation from any Appendix may be combined with one or more feature, part, component, method step, function or operation from the detailed description provided herein, to form an independent invention or a combination invention. Additionally, any feature, part, component, method step, function or operation from either the detailed description or the appendices may be combined with one or more conventional or prior art features, parts, components, method steps, functions or operations to form an independent invention or a combination invention.

The following discussion and accompanying figures disclose sole structures for articles of footwear. To assist and clarify the subsequent description of various embodiments, various terms are defined herein. Unless otherwise indicated, the following definitions apply throughout this specification (including the claims). For consistency and convenience, directional adjectives are employed throughout this detailed description corresponding to the illustrated embodiments. The term "longitudinal," as used throughout this detailed description and in the claims, refers to a direction extending a length of a component. For example, a longitudinal direction of an article of footwear extends between a forefoot region and a heel region of the article of footwear. The term "forward" is used to refer to the general direction from a heel region to a forefoot region, and the term "rearward" is used to refer to the opposite direction, i.e., the direction from a forefoot region to a heel region. The term "lateral direction," as used throughout this detailed description and in the claims, refers to a side-to-side direction extending a width of a component. The term "vertical," as used throughout this detailed description and in the claims, refers to a direction generally perpendicular to both the lateral and longitudinal directions.

Figure 2:
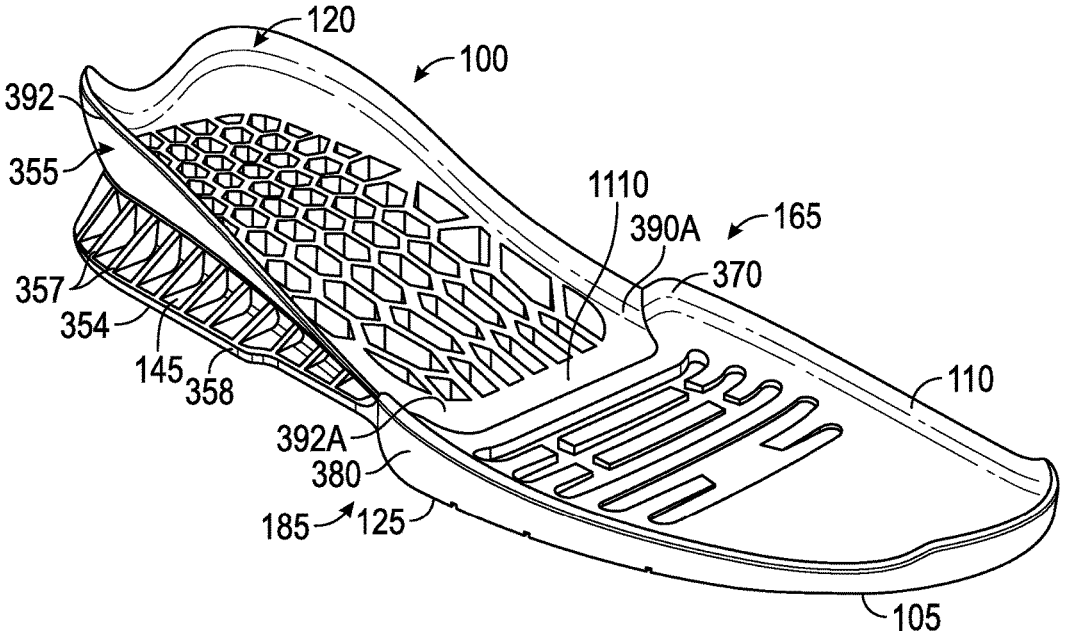
FIG. 2 is an isometric lateral view of the sole structure of FIG. 1.

Referring to FIG. 1, an isometric medial side view of a sole structure 100 for an article of footwear ("article") is depicted, and in FIG. 2, an isometric lateral side view of sole structure 100 is depicted. In different embodiments, sole structure 100 can be used in an athletic shoe, such as a weightlifting shoe. However, in other embodiments, sole structure 100 may be used with other kinds of footwear.

As noted above, for consistency and convenience, directional adjectives are employed throughout this detailed description. Sole structure 100 and features and components thereof may be divided into three general regions along a longitudinal axis 180: a forefoot region 105, a midfoot region 125, and a heel region 145. Since various features of sole structure 100 extend beyond one region of sole structure 100, the terms forefoot region 105, midfoot region 125, and heel region 145 apply not only to sole structure 100, but also to the various features of sole structure 100.

Referring to FIG. 1, for reference purposes, a lateral axis 190 of sole structure 100, and any components related to sole structure 100, may extend between a medial side 165 and a lateral side 185 of the foot. It will be understood that each of these directional adjectives may also be applied to individual components of an article of footwear, such as an upper and/or a sole member. In addition, a vertical axis 170 refers to the axis perpendicular to a horizontal surface defined by longitudinal axis 180 and lateral axis 190. In addition, the term "proximal" refers to a relative position that is nearer or toward a foot when the foot is inserted into an article that incorporates sole structure 100. Likewise, the term "distal" refers to a relative position that is further away from a foot when a foot is inserted into an article that incorporates sole structure 100. Thus, the terms proximal and distal may be understood to provide generally opposing terms to describe the relative spatial positions of components or portions of a component of the sole structure 100.

As noted above, sole structure 100 may be incorporated into an article of footwear. The article of footwear can include an upper as well as sole structure 100. Generally, the upper used with sole structure 100 may be any type of upper. In some embodiments, sole structure 100 may include multiple components, which may, individually or collectively, provide sole structure 100 with a number of attributes, such as support, rigidity, flexibility, stability, incompressibility, cushioning, comfort, reduced weight, or other attributes. In some embodiments, as shown in FIGS. 1 and 2, sole structure 100 includes a base component 110 and a wedge component 120. For purposes of clarity for the reader, a series of exploded illustrations are presented in FIGS. 3-10, providing isolated views of base component 110 and wedge component 120.

For purposes of describing the geometry of sole structure 100, the term height may be used. The term "height" as used throughout this detailed description and in the claims refers to the approximate distance between a portion of sole structure 100 and a reference point (or surface) having a relatively fixed vertical position. For example, in some cases, the height may refer to the approximate distance between a portion of sole structure 100 and a plane coincident with an outer peripheral edge of sole structure 100. In other cases, the height could be measured as the approximate vertical distance between two adjacent portions. In some cases, the height of sole structure 100 may vary over different regions. In some embodiments, an increase in height of a portion of a sole structure component relative to another portion of the same component may correspond to a relative increased thickness of the same portion.

Figure 3:
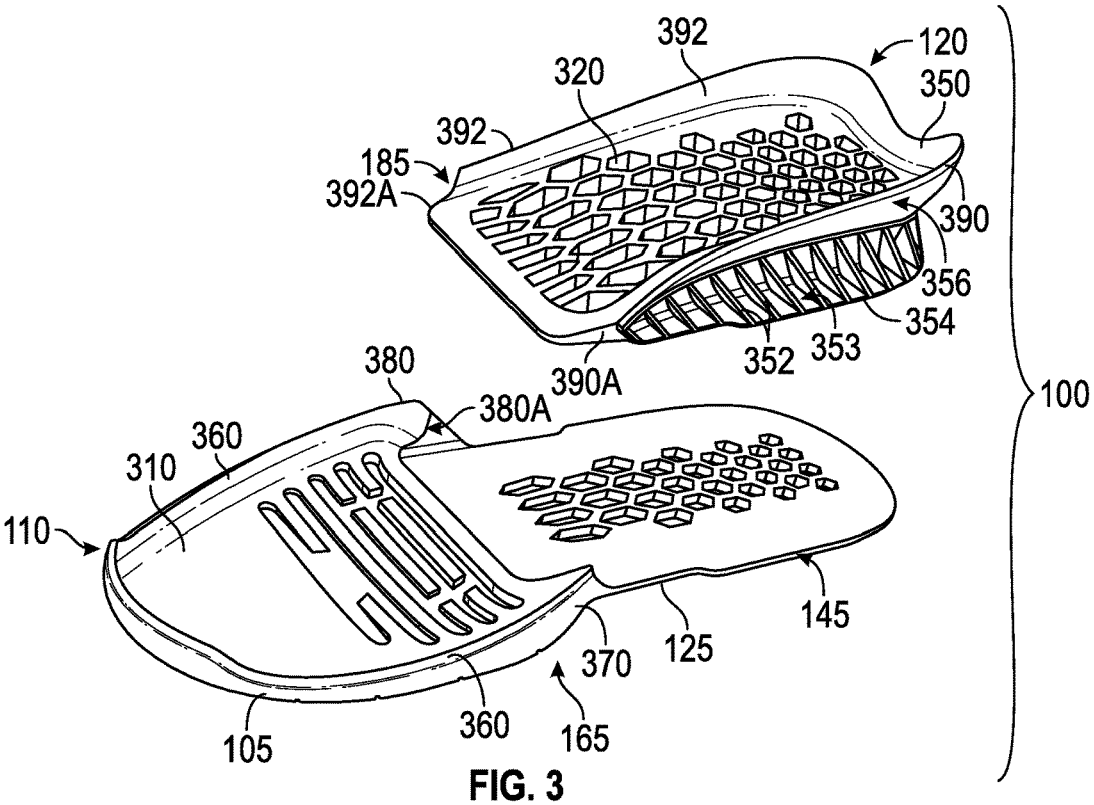
FIG. 3 is an exploded isometric medial view of the sole structure of FIG. 1.
Figure 4:
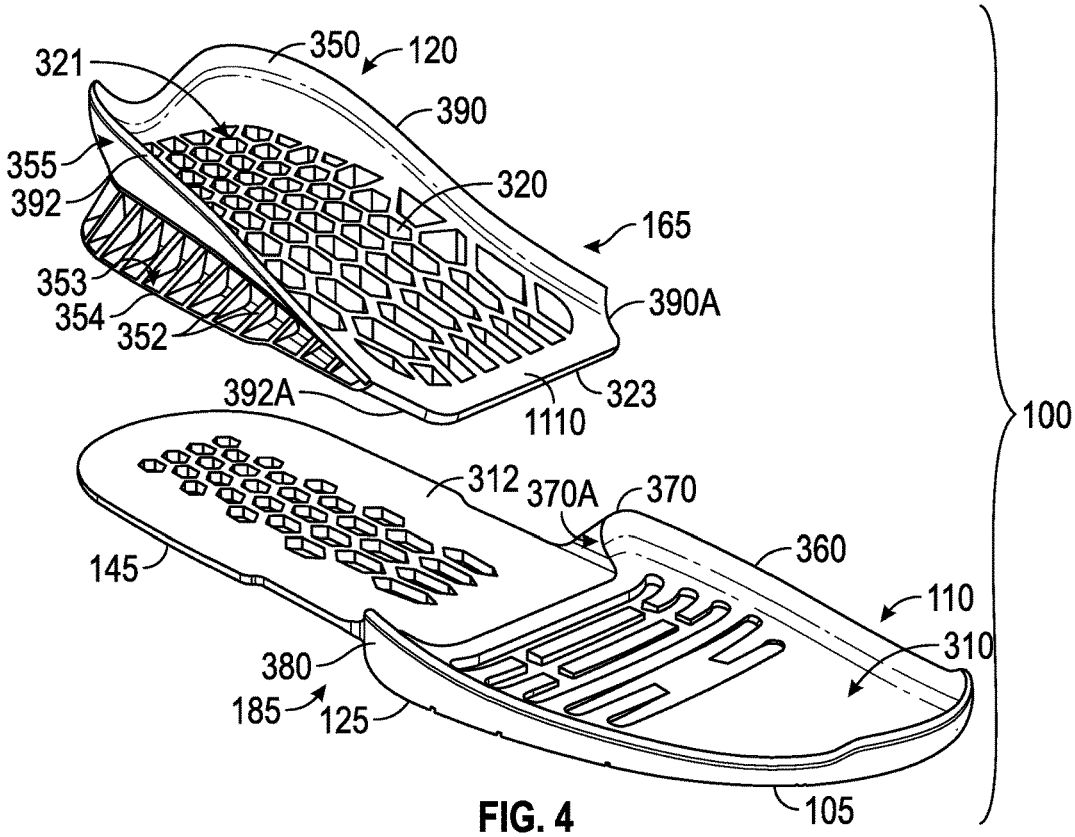
FIG. 4 is an exploded isometric lateral view of an embodiment of the sole structure of FIG. 1.
Figure 5:
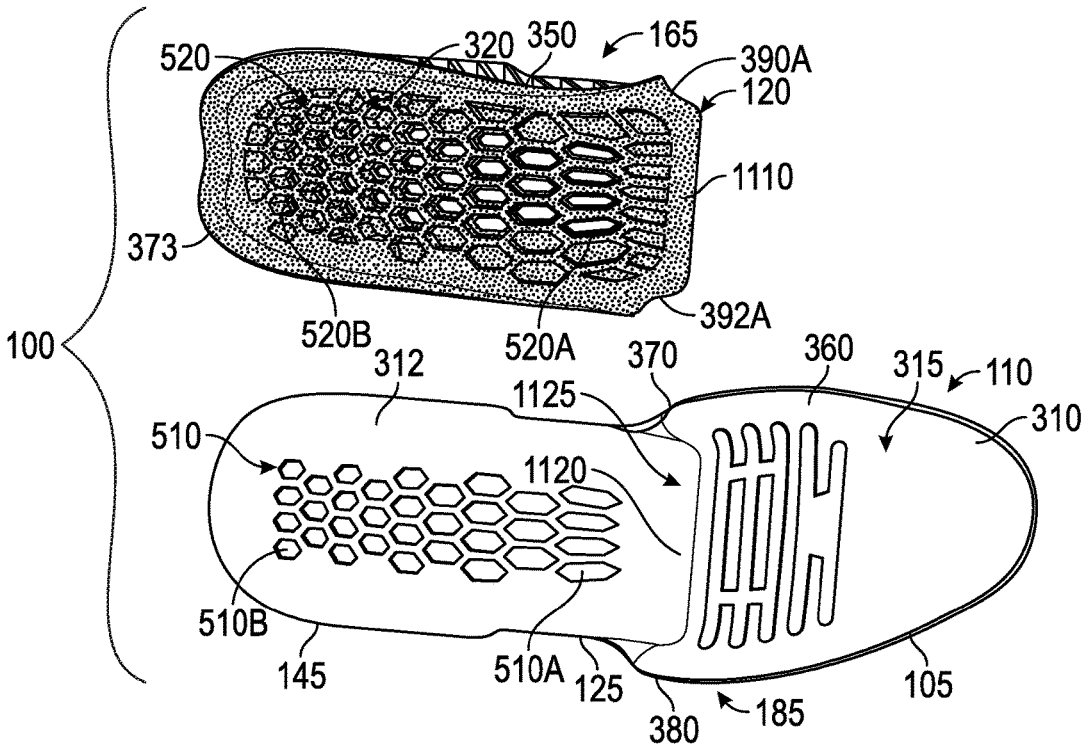
FIG. 5 is an exploded plan view of an embodiment of the sole structure of FIG. 1.

FIGS. 3-5 illustrate various exploded views of a proximal side of sole structure 100. In FIG. 3, an exploded isometric medial view of an embodiment of sole structure 100 is shown, and in FIG. 4, an exploded isometric lateral view of an embodiment of sole structure 100 is shown. Furthermore, FIG. 5 depicts an exploded top-down view of an embodiment of sole structure 100. As shown in FIGS. 3-5, base component 110 may include a base portion that comprises the lower portion of base component 110 and is generally aligned through a horizontal plane. The base portion may extend from forefoot region 105 to heel region 145 of sole structure 100. For purposes of reference, base component 110 comprises a base portion that includes a forward base portion ("forward portion") 310 and a rearward base portion ("rearward portion") 312. In different embodiments, the thickness associated with forward base portion 310 and rearward base portion 312 can differ. For example, as seen in the figures, the thickness associated with forward base portion 310 is substantially greater than the thickness associated with rearward base portion 312. Stated differently, the forward base portion 310 is thicker than the rearward base portion 312.

In some embodiments, forward base portion 310 comprises that portion of the base component 110 that is disposed in forefoot region 105. In other embodiments, as shown in FIGS. 3-5, forward base portion 310 extends through forefoot region 105 and also extends at least partly into midfoot region 125. Furthermore, rearward base portion 312 can be understood to be disposed further toward heel region 145 relative to forward base portion 310. In some embodiments, rearward base portion 312 comprises a portion of base component 110 that is disposed in heel region 145. In other embodiments, as shown in FIGS. 3-5, rearward base portion 312 extends through heel region 145 and also extends at least partly into midfoot region 125. In some embodiments, rearward base portion 312 can be understood to be the portion of the base component 110 that is configured to receive, accommodate, be in contact with, and/or be disposed adjacent to wedge component 120. In some embodiments, forward base portion 310 and rearward base portion 312 may each be characterized as a portion of base component 110 with a relatively low degree of curvature. In some cases, forward base portion 310 and rearward base portion 312 may each be characterized as a portion of base component 110 over which the height of base component 110 remains substantially small or shallow relative to the periphery of the base component 110. In other cases, however, the heights of forward base portion 310 and rearward base portion 312 could vary in any manner. Also, in other cases, the curvature of forward base portion 310 and rearward base portion 312 could vary in another manner. Furthermore, the base component 110 can include recesses, holes, openings, gaps, or other types of texturing or patterning in different embodiments, though in some embodiments, the surfaces of base component 110 may be substantially smooth.

In addition, in some embodiments, wedge component 120 may include a central portion 320. Central portion 320 may extend through a substantial majority or an entirety of the longitudinal length of wedge component 120. Central portion 320 may represent the central region of wedge component 120, and may be referred to as a central region. In different embodiments, central portion 320 can be substantially contoured, and in some embodiments, the proximal surface of central portion 320 can be contoured to support a heel region or midfoot region of a user's foot. Furthermore, the central portion 320 can include recesses, holes, openings, gaps, or other types of texturing or patterning in different embodiments, though in some embodiments, central portion 320 may be substantially smooth.

In some cases, a sole structure component such as base component 110 and/or wedge component 120 can incorporate one or more portions of increased height or thickness that enhance structural support, or regions that have different types of curvature. In some cases, the portions of increased height can be shaped to distribute forces and/or allow for particular regions of bending. In some embodiments, the regions with increased height or varying curvature can be configured to accommodate and/or strengthen the joining or attachment of two or more components and/or facilitate the assembly of the sole structure.

In some embodiments, for example, one or more of the components comprising sole structure 100 may include one or more peripheral flanges. The term "peripheral flange" as used throughout this detailed description and in the claims refers to any portion of a sole structure component that extends upwardly or proximally from a base portion of the sole structure component.

Figure 18:
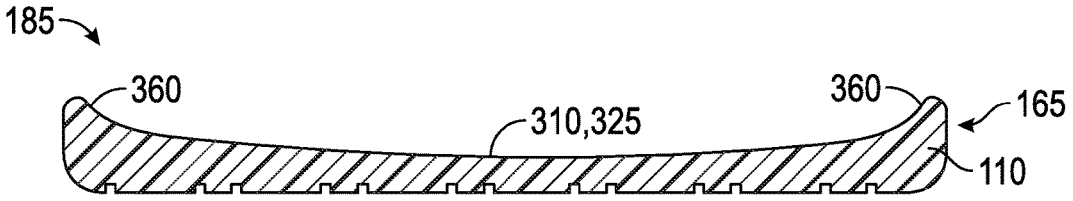
FIG. 18 is a cross-sectional view of an embodiment of the sole structure of FIG. 17 along the line 18-18.
Figure 19:
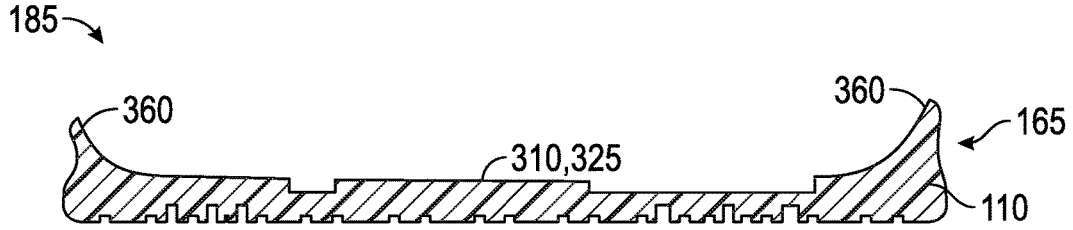
FIG. 19 is a cross-sectional view of an embodiment of the sole structure of FIG. 17 along the line 19-19.

Thus, referring to FIGS. 3 and 4, it can be seen that in some embodiments, a first peripheral flange 360 surrounds a central region 325 of forward base portion 310. In some cases, first peripheral flange 360 may extend around a substantial majority or all of the outer periphery or a first peripheral portion of forward base portion 310. In other words, along the perimeter or peripheral region of forward base portion 310, the structure of base component 110 has a greater height relative to the height of the central region 325. This can also be seen in the cross-sectional views provided in FIGS. 18-19.

In different embodiments, first peripheral flange 360 may generally extend upwardly (i.e., in a proximal direction) from the proximal side of sole structure 100. In some cases, first peripheral flange 360 may be characterized as comprising raised surfaces or raised plateaus of sole structure 100. Moreover, the average height of first peripheral flange 360 may be substantially greater than the average height of the central region 325 through forward base portion 310 in some embodiments (see FIG. 3). Furthermore, peripheral flange 360 can be curved and extend gradually upward, or it may extend directly upward from the central region 325 in different embodiments.

In some embodiments, first peripheral flange 360 may be integrally formed with the central region 325 and the remainder of forward base portion 310. In particular, in some cases, first peripheral flange 360 and central region 325 may comprise a single monolithic structure. Similarly, forward base portion 310 and rearward base portion 312 can be integrally formed with one another. For example, in some cases, first peripheral flange 360 and forward base portion 310 may be formed from a single material layer or from multiple layers stacked together. In other cases, however, first peripheral flange 360 may be a separate component from the central region 325.

Generally, first peripheral flange 360 may be disposed in different regions of sole structure 100. In some cases, first peripheral flange 360 may extend through forefoot region 105 and at least part of midfoot region 125. In other cases, however, first peripheral flange 360 could be disposed in only forefoot region 105 and/or only midfoot region 125.

In different embodiments, the peripheral shape of a peripheral flange can vary. Examples of different peripheral shapes for a peripheral portion include, but are not limited to: rounded, circular, elliptical, triangular, square, rectangular, polygonal, regular, irregular, symmetric, asymmetric as well as other kinds of shapes. In one embodiment, first peripheral flange 360 may have an approximately U-shape, as seen in FIGS. 3 and 4. This U-shape may be associated with a medial edge, a lateral edge, and a forward edge of base component 110. In one embodiment, first peripheral flange 360 may have an approximately rounded or curved peripheral shape. It will be understood that the peripheral shapes used to describe first peripheral flange 360 are only intended as approximations. For example, first peripheral flange 360 may only be approximately U-shaped and deviations from this approximate shape occur along different portions of the edges of first peripheral flange 360. In other embodiments, first peripheral flange 360 may include gaps or discontinuities around the periphery or the first peripheral portion of base component 110. In some embodiments, it can be understood that the central region 325 of forward base portion 310 may be surrounded by or bounded by first peripheral flange 360 along the outer periphery.

In some embodiments, first peripheral flange 360 may further include a forward medial flange portion ("forward medial flange") 370 and a forward lateral flange portion ("forward lateral flange") 380 indicated in FIGS. 4 and 5. Forward medial flange is a rearmost portion of first peripheral flange 360 at medial side 165, and forward lateral flange 380 is a rearmost portion of first peripheral flange 360 at lateral side 185. A flange can extend in different directions in different embodiments. In FIGS. 3 and 4, it can be seen that the flanges 370, 380 extend or are elongated in a generally rearward direction, for example. Furthermore, extending between forward medial flange 370 and forward lateral flange 380 is an intermediate portion 1120 of rearward base portion 312, seen more clearly and labeled in FIGS. 5 and 10. The intermediate portion 1120 is a forwardmost extent of the rearward base portion 312.

In some embodiments, each of forward medial flange 370 and forward lateral flange 380 can have different shapes. In particular, the thickness of either of forward medial flange 370 and forward lateral flange 380 may generally increase toward forefoot region 105 and/or decrease toward midfoot region 125. This can be seen more clearly in the top-down view of FIG. 5. In still another embodiment, the width or thickness of a flange portion could remain approximately constant.

Referring to FIGS. 3 and 4, it can also be seen that in some embodiments, forward medial flange 370 and/or forward lateral flange 380 may include an inner surface 370A, 380A, respectively. In other words, there may be a portion of the flanges that extends from the outer periphery toward the interior of base component 110, extending toward the area where forward base portion 310 and rearward base portion 312 are joined or where forward base portion 310 and rearward base portion 312 meet. These inner surfaces 370A, 380A of the flange portions 370, 380 can thus border or surround a forward extent of rearward base portion 312 in some embodiments.

Figure 10:
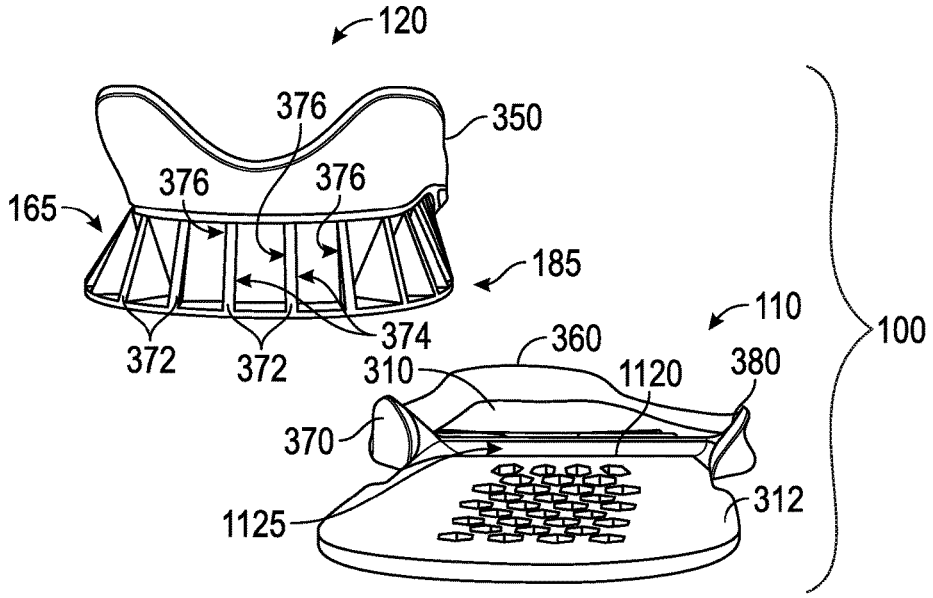
FIG. 10 is an exploded rear view of an embodiment of the sole structure of FIG. 1.

In some embodiments, the inner surface 370A, 370B of flange 370, 380 can be substantially smooth and/or flat. However, in other embodiments, the inner surface 370A, 380A of each of the flanges 370, 380 includes a curvature that can facilitate the attachment, joining, or "docking" of base component 110 with wedge component 120. In some embodiments, the curvature of the inner surface can be understood to bulge or protrude outward as it extends upward. In other words, in some embodiments, there may be a dip or recessed surface area of one or both of the forward flanges 370, 380 nearer the rear base portion 312 and as the flange portion 370, 380 rises or extends upward in a proximal direction, it may bend or bulge inward toward the centerline of the sole structure 100 (i.e., have a convex inner surface that protrudes toward a longitudinal centerline of the sole structure 100), forming a small overhang. Stated differently, the surface 370A is a medial shoulder and the surface 380A is a lateral shoulder, and each of the shoulders protrudes inward adjacent the sloped proximal surface 1125 as best seen in FIG. 10. In one embodiment, this overhang of the flanges 370, 380 can comprise a grooved structure that can help to snugly receive another component, such as the tongue 1110 of the wedge component 120 as described herein. The curvature corresponds to (i.e., matingly interfits and is coextensive with) curvature of abutting portions of wedge component 120 to facilitate the joining of base component 110 and wedge component 120.

Figure 20:
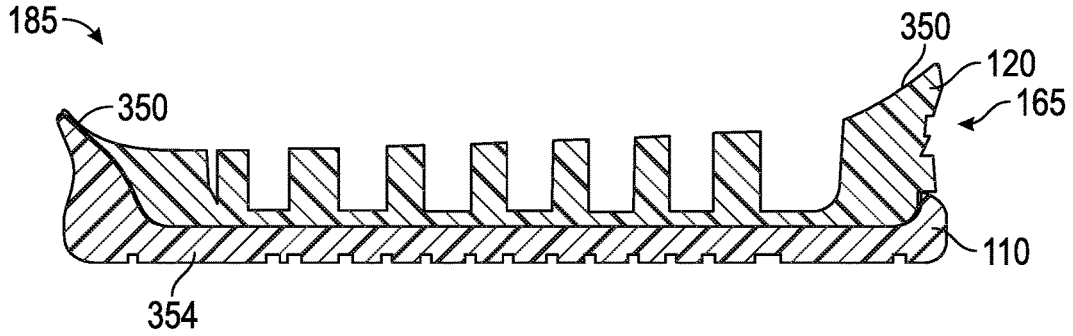
FIG. 20 is a cross-sectional view of an embodiment of the sole structure of FIG. 17 along the line 20-20.
Figure 24:
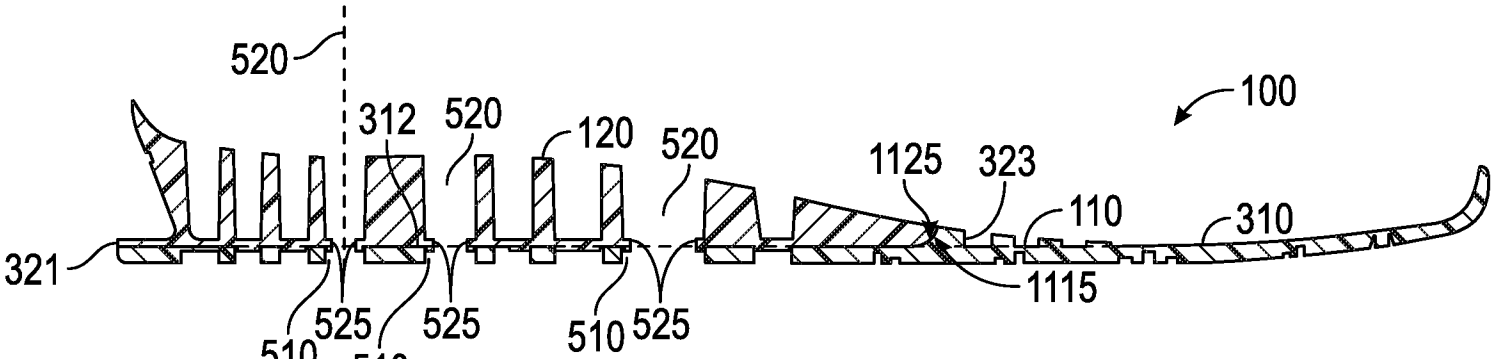
FIG. 24 is a cross-sectional view of an embodiment of the sole structure of FIG. 17 along the line 24-24.
Figure 25:
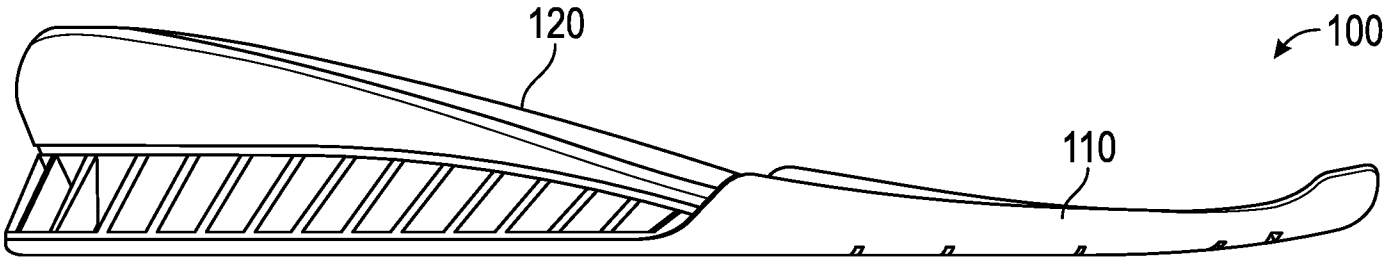
FIG. 25 is a lateral side view of an embodiment of the sole structure of FIG. 1.
Figure 26:
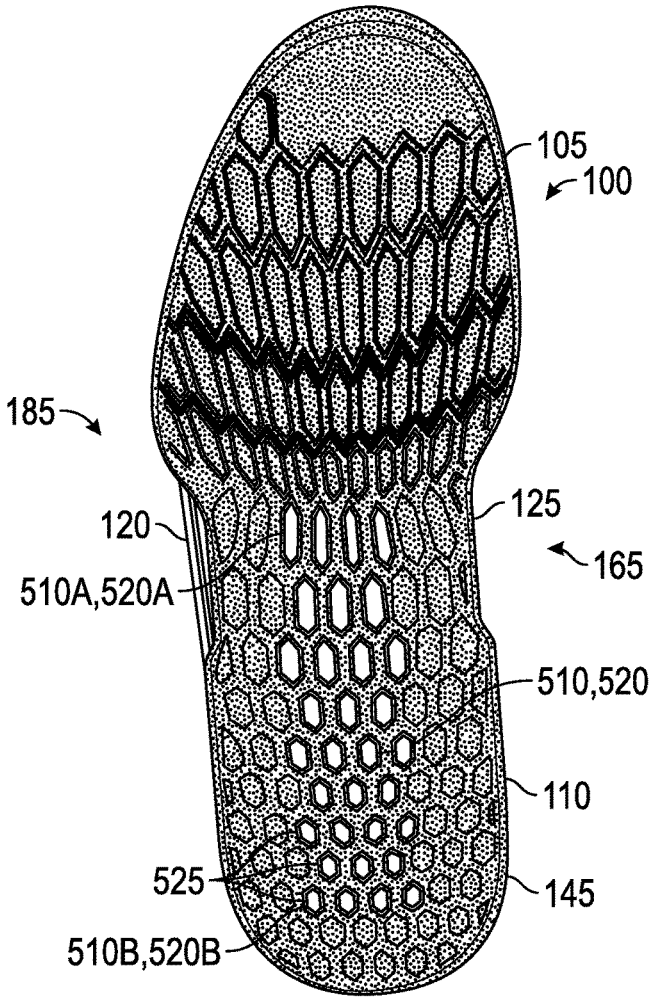
FIG. 26 is a bottom view of an embodiment of the sole structure of FIG. 1.
Figure 27:
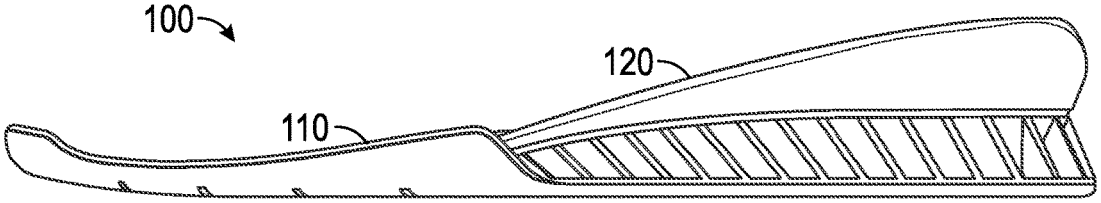
FIG. 27 is a medial side view of an embodiment of the sole structure of FIG. 1.
Figure 28:
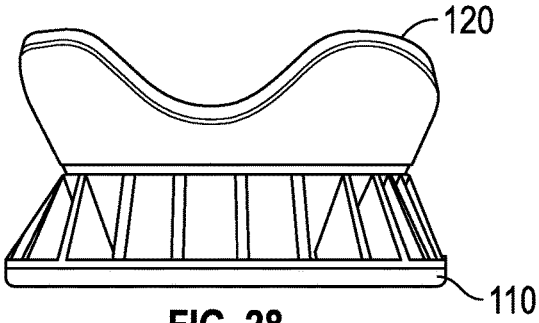
FIG. 28 is a rear view of an embodiment of the sole structure of FIG. 1.

The wedge component 120 overlies the rearward base portion 312 and tapers in height from a rear extent 321 of the wedge component 120 to a foremost extent 323 of the wedge component 120, as indicated in FIG. 24. Furthermore, in different embodiments, wedge component 120 can include structural characteristics that can facilitate and/or strengthen the joining or bond between base component 110 and wedge component 120. Referring to FIGS. 3 and 4, it can be seen that in some embodiments, a second peripheral flange ("second peripheral flange") 350 partially surrounds central portion 320 of wedge component 120. In some cases, second peripheral flange 350 may extend around a substantial majority of the outer periphery or a second peripheral portion of central portion 320. In other words, along the perimeter or peripheral region of central portion 320, the structure of wedge component 120 has a greater height relative to the height of central portion 320. This can also be seen in the cross-sectional views provided in FIGS. 20-22.

In different embodiments, second peripheral flange 350 may generally extend upwardly (i.e., in a proximal direction) from the proximal side of sole structure 100. In some cases, second peripheral flange 350 may be characterized as comprising raised surfaces or raised plateaus of sole structure 100. Moreover, the average height of second peripheral flange 350 may be substantially greater than the average height of central portion 320 in some embodiments.

In some embodiments, second peripheral flange 350 may be integrally formed with central portion 320. In particular, in some cases, second peripheral flange 350 and central portion 320 may comprise a single monolithic structure. For example, in some cases, second peripheral flange 350 and central portion 320 may be formed from a single material layer or from multiple layers stacked together. In other cases, however, second peripheral flange 350 may be a separate component from central portion 320. In some cases, second peripheral flange 350 may extend through heel region 145 and at least part of midfoot region 125.

In different embodiments, the shape of a peripheral flange portion can vary. In one embodiment, second peripheral flange 350 may have an approximately U-shape in plan view, as seen in FIGS. 3 and 4. This U-shape shape may be associated with a medial edge, a lateral edge, and a rear edge of wedge component 120. In one embodiment, second peripheral flange 350 may have an approximately rounded or curved peripheral shape. It will be understood that the peripheral shapes used to describe second peripheral flange 350 are only intended as approximations. For example, second peripheral flange 350 may only be approximately U-shaped and deviations from this approximate shape occur along different portions of the edges of second peripheral flange 350. In other embodiments, second peripheral flange 350 may include gaps or discontinuities around the periphery of wedge component 120. In some embodiments, it can be understood that central portion 320 is substantially surrounded by or bounded by second peripheral flange 350 along the outer periphery. Furthermore, as can be seen more clearly in FIG. 10, in some embodiments, there may be a "dip" or lessening of the height of second peripheral flange 350 at a rear of the peripheral flange 350. However, in other embodiments, the height may be substantially uniform, or there may be dips or changes in the overall contour of the peripheral flanges that are not depicted in the figures.

In some embodiments, second peripheral flange 350 may further include a rearward medial flange 390 and a rearward lateral flange 392 (see FIG. 4), and the wedge component 120 may further include a tongue (see tongue 1110 in FIGS. 5, 7, and 11) that extends between rearward medial flange 390 and rearward lateral flange 392. The tongue 1110 is at the foremost extent 323 of the wedge component 120, as shown in FIG. 4. Rearward medial flange 390 extends from medial side 165 of second peripheral flange 350 and rearward lateral flange 392 extends from lateral side 185 of second peripheral flange 350. A tapered portion 390A, 392A can extend from the rearward medial flange 390 and from the rearward lateral flange 392, respectively. The tapered portions 390A, 392A can extend in different directions in different embodiments. In FIGS. 3 and 4, it can be seen that the tapered portions 390A, 392A extend or stretch toward a generally forward direction, for example. Rearward medial flange 390 and rearward lateral flange 392 can each comprise a portion of wedge component 120 that extends slightly toward the center of sole structure 100, and in some embodiments, each tapered portion 390A, 392A comprises a distal surface 391, 393, respectively, that is configured to contact the inner surface 370A, 370B of a corresponding flange portion of base component 110. The distal surfaces 391, 393 are also referred to herein as confronting surfaces.

Thus, it can also be seen that in some embodiments, the distal surfaces 391, 393 of the tapered portions 390A, 392A extend downwardly and inwardly from the outer periphery of the second peripheral flange 350 toward a central region 320 of a base portion 312 of the wedge component 120 (e.g., toward a longitudinal center of wedge component 120), extending toward and joining the tongue 1110. The shape of the confronting surfaces can differ in different embodiments.

In some embodiments, the confronting surface of each tapered portion 390A, 392A can be substantially smooth and/or flat. However, in other embodiments, the surface of each of the tapered portions 390A, 392A includes a curvature that can facilitate the attachment, joining, or "docking" of base component 110 with wedge component 120. In some embodiments, the curvature of the confronting surface of a tapered portion can be understood to recede slightly inward as it approaches the tongue (see tongue 1110 in FIGS. 5, 7, and 11). In the same or other embodiments, the curvature can be configured to correspond to curvature of the forward lateral flange 380 and the forward medial flange 370 of base component 110 to help facilitate the joining of base component 110 and wedge component 120.

In some embodiments, it can be understood that forward base portion 310 includes a forefoot surface 315 (facing upward) and intermediate portion 1120 includes a sloped proximal surface 1125 that faces generally rearward and at which the base component 110 decreases in height from the forward base portion 310 to the rearward base portion 312. In some embodiments, each of rearward medial flange 390 and rearward lateral flange 392 can have different shapes. In addition, in some embodiments, the tongue 1110 of wedge component 120 includes an at least partially forward-facing surface 1115 at a bottom side (i.e., a sloped distal surface 1115, shown in FIGS. 6, 9, and 24) that can be configured to contact or abut the sloped proximal surface 1125 of the intermediate portion 1120 of forward base portion 310, as shown in FIG. 24. Intermediate portion 1120 can comprise a recessed region or surface of forward base portion 310.

Intermediate portion 1120 extends between forward lateral flange 380 and forward medial flange 370. The sloped distal surface 1115 can be approximately aligned with a vertical plane in some embodiments. Because the forward base portion 310 is thicker than the rearward base portion 312, the sloped distal surface 1115 serves as a stepped surface. In some embodiments, the tongue 1110 is associated with a smaller thickness or height relative to the rest of wedge component 120. In addition, the curvature of the sloped proximal surface 1125 and height of intermediate portion 1120 can be configured to receive or snugly accommodate the sloped distal surface 1125 of the tongue 1110, with the tongue nested between the shoulders of the medial and lateral flanges 370, 380. For example, the surfaces 370A, 370B and sloped distal surface 1115 of the base component 110 can define a groove that snugly receives the tongue 1110, with the tongue 1110 overlying and abutting the recessed intermediate portion 1120. The sloped distal surface 1115 abuts and is coextensive with the sloped proximal surface 1125 of the base component 110.

Figure 7:
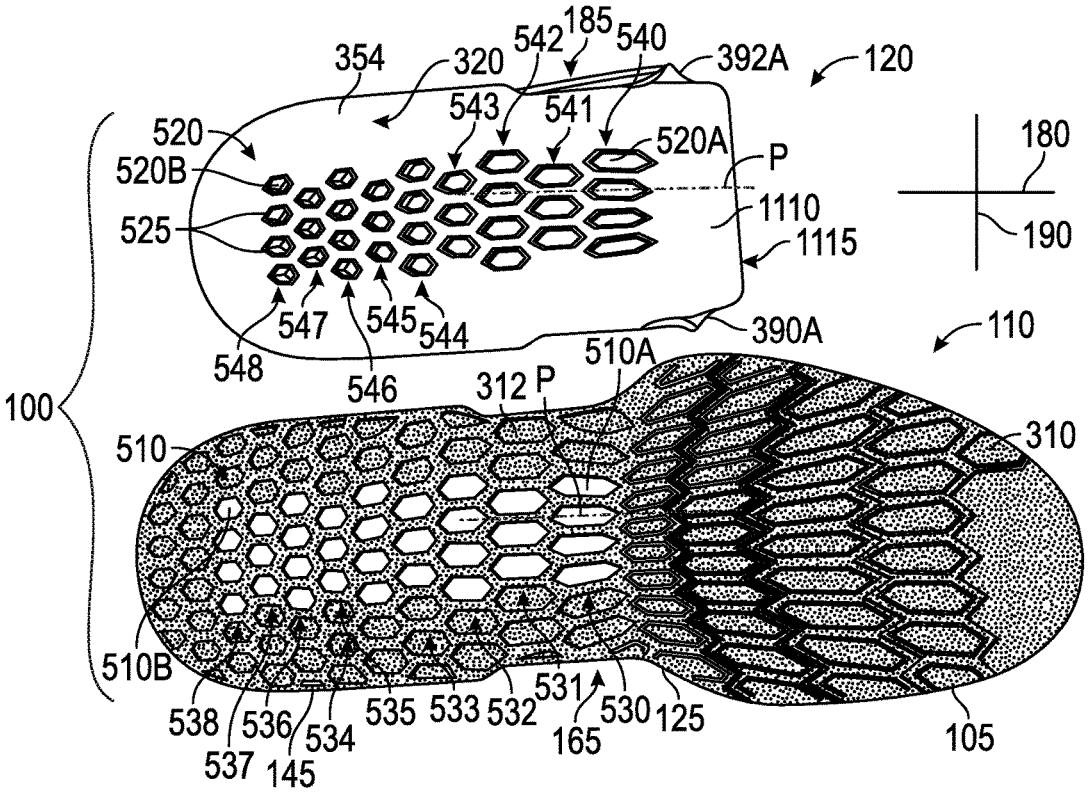
FIG. 7 is an exploded bottom view of an embodiment of the sole structure of FIG. 1.
Figure 11:
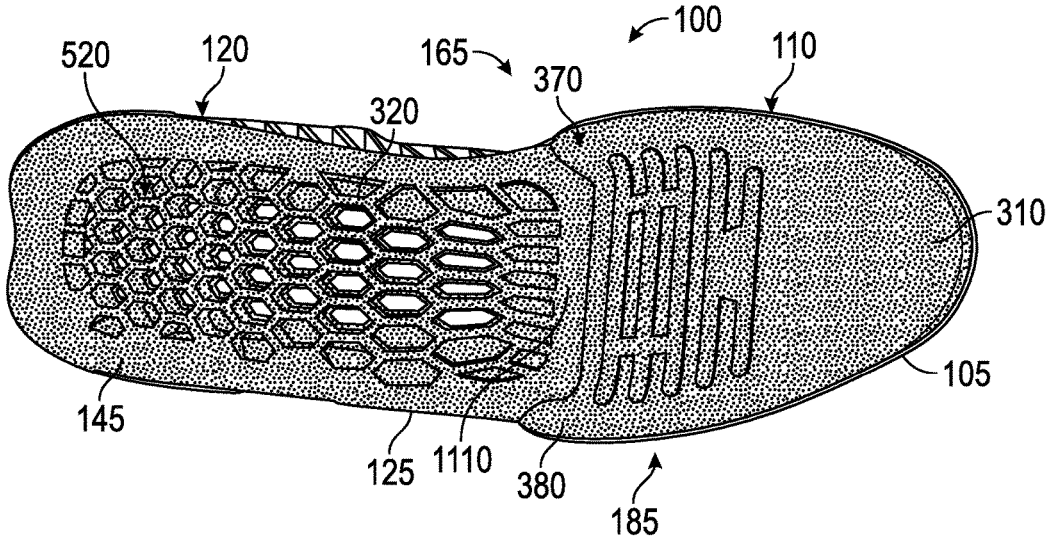
FIG. 11 is a top-down view of an embodiment of the sole structure of FIG. 1.

For example, as shown in FIGS. 5, 7, and the assembled top-down view of FIG. 11, in some embodiments, the connection between base component 110 and wedge component 120 can be bolstered or strengthened by the "fit" of a tongue 1110 of wedge component 120 into or against the grooved recessed region associated with intermediate portion 1120. This can be seen in FIGS. 5 and 7, where the top-down views show the distinct portions that may be linked. For example, as shown in FIG. 11, the interlocking or insertion of tongue 1110 into the groove formed by the two flange portions 370, 380 extending along the sides of intermediate portion 1120 (see FIG. 5) can enhance the structural attachment between the two components. In some embodiments, the height of the forward-facing surface 1115 can be substantially similar to the height of intermediate portion 1120, allowing a flush connection and a substantially smooth interface between the two components. Thus, in one embodiment, a partial tongue-and-groove joint or lap joint can be formed between base component 110 and wedge component 120. In addition, in some embodiments, the forward lateral flange 380 can abut the rearward lateral flange 392. Furthermore, in some embodiments, the forward medial flange 370 abuts the rearward medial flange 390. In one embodiment, both the forward lateral flange can abut the rearward lateral flange and the forward medial flange can abut the rearward medial flange. Because the tongue 1110 is nested between the abutting flange portions, the wedge component 120 is nested and "locked" in the base component 110. This "locking" together of the forward flanges with the rearward flanges can strengthen the attachment between the two components in different embodiments.

In other words, in some embodiments, the proximal surface of the forward base portion can have a forefoot surface 315 and a recessed surface 1125 at intermediate portion 1120 that is disposed rearward of the forefoot surface 315. In one embodiment, the recessed surface region is disposed or extends between the rearward ends of the forward flanges 370, 380 as they abut the wedge component 120. Thus, the wedge component 120 can have a tongue 1110 that is received into the recess at recessed surface 1125 in some embodiments.

Figure 6:
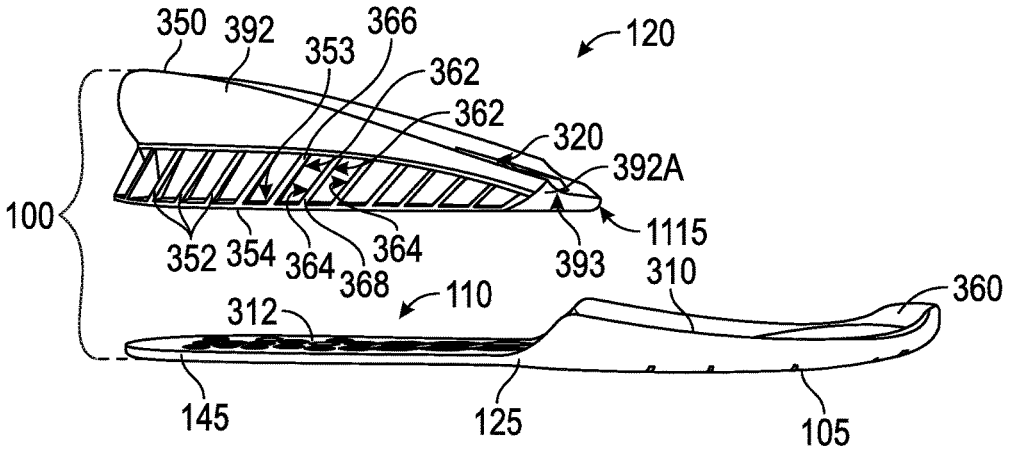
FIG. 6 is an exploded lateral side view of the sole structure of FIG. 1.

Furthermore, in some embodiments, as noted earlier, each of base component 110 and/or wedge component 120 can include openings, apertures, or recesses. For example, as shown in the top-down view of FIG. 5, base component 110 includes a first set of through-holes ("first set") 510 and wedge component 120 includes a second set of through-holes ("second set") 520. However, as shown in FIGS. 6 and 7, it should be understood that, in some embodiments, while the holes formed in portions of base component 110 and wedge component 120 may be through-holes, other holes formed in different portions of base component 110 and wedge component 120 may be blind-holes. For purposes of this disclosure, a "through-hole" refers to a type of hole that includes a first open end along one surface side (e.g., a distal surface) and a second open end along a second, opposing surface side (e.g., a proximal surface). In other words, the hole has a continuous opening extending through the interior or thickness of the sole member. Each of the two ends of the hole may match or correspond in dimension and shape with each other. For example, referring to the cross-sectional views of FIGS. 21 and 22, it can be seen that the through-holes extend through the thickness of the components and are associated with openings along both a proximal surface and a distal surface of the components. In contrast, a "blind-hole" is a recessed portion of the component, and includes a first open end formed along one surface side (i.e., either the distal surface or the proximal surface), extends partway through the thickness of the sole component, and ends at a second closed end bounded by the material of the sole component.

Thus, while first set 510 and second set 520 comprise through-holes within each of the sole components 110, 120 of sole structure 100, it should be understood that in some embodiments, base component 110 and/or wedge component 120 can also include an arrangement or pattern of blind-holes. In one embodiment, there may be a hole through the component(s) that includes a thin layer or portion of material that "closes off" the hole for example. The figures depict only some embodiments meant to illustrate one configuration for holes. In other embodiments, the number of holes, as well as their general configuration or arrangement along the sole component, may vary.

Figure 12:
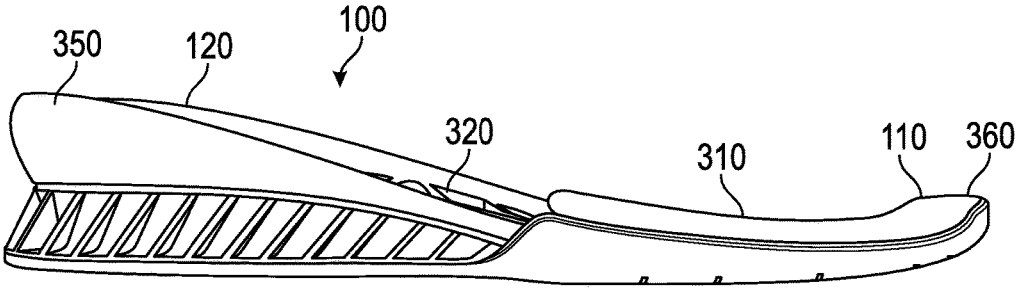
FIG. 12 is a lateral side view of an embodiment of the sole structure of FIG. 1.
Figure 13:
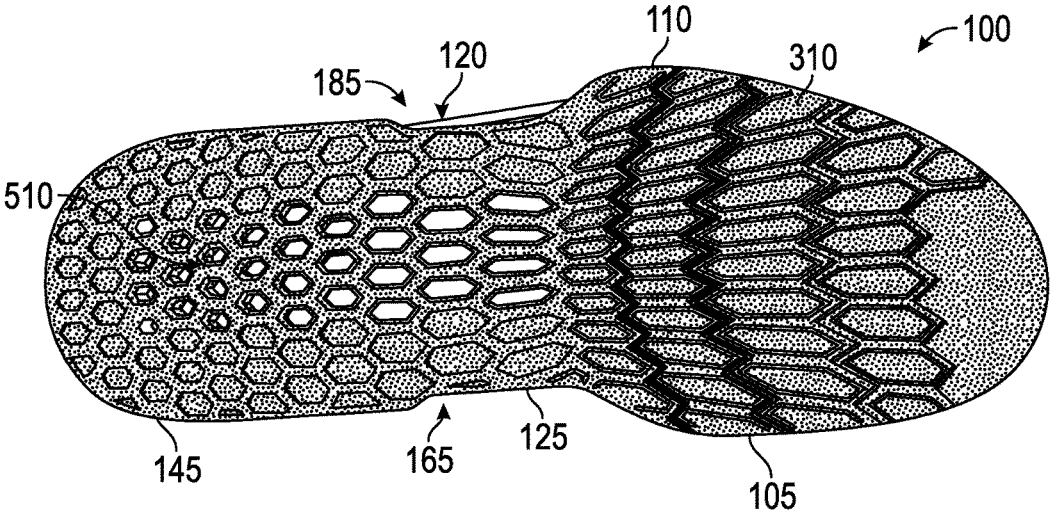
FIG. 13 is a bottom view of an embodiment of the sole structure of FIG. 1.
Figure 14:
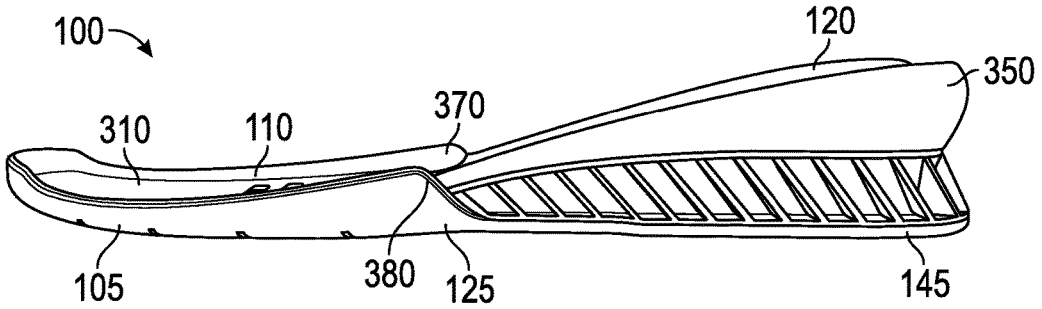
FIG. 14 is a medial side view of an embodiment of the sole structure of FIG. 1.
Figure 15:
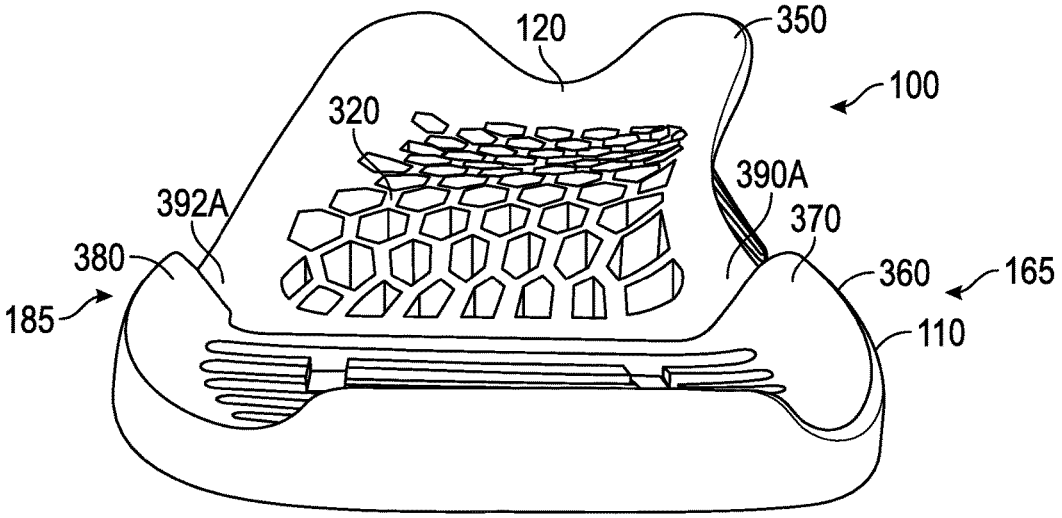
FIG. 15 is a front view of an embodiment of the sole structure of FIG. 1.
Figure 21:
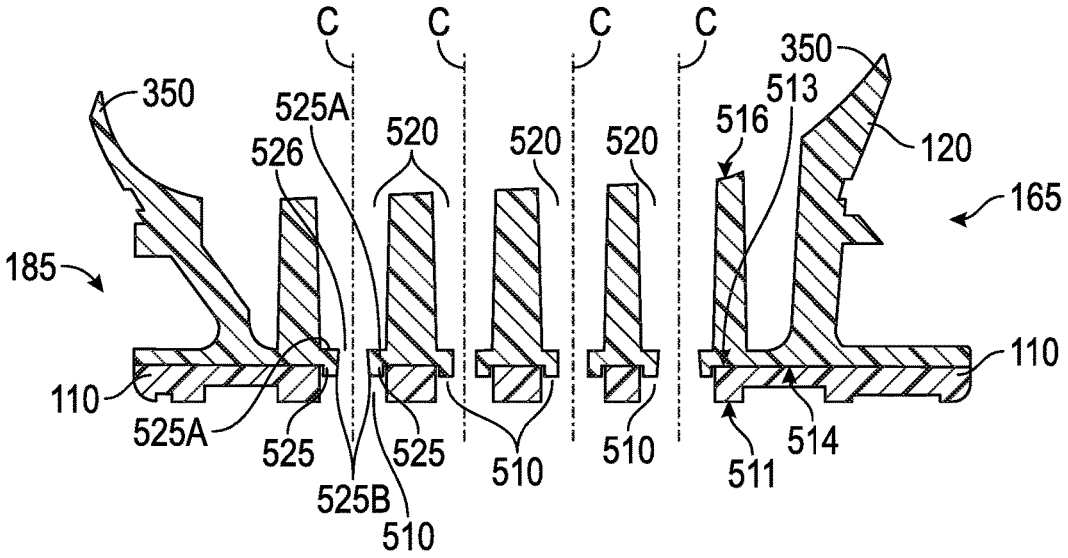
FIG. 21 is a cross-sectional view of an embodiment of the sole structure of FIG. 17 along the line 21-21.
Figure 22:
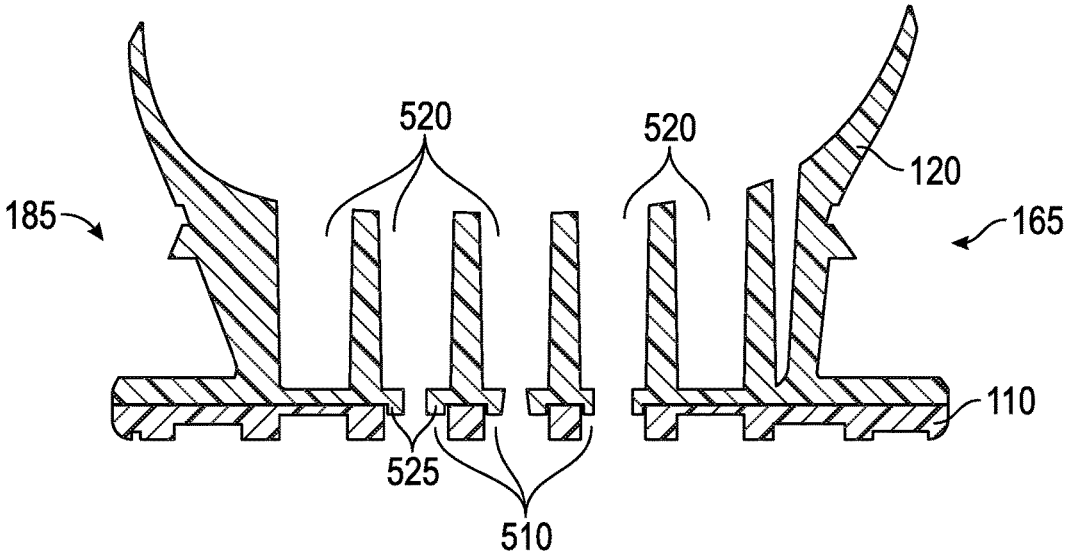
FIG. 22 is a cross-sectional view of an embodiment of the sole structure of FIG. 17 along the line 22-22.
Figure 23:
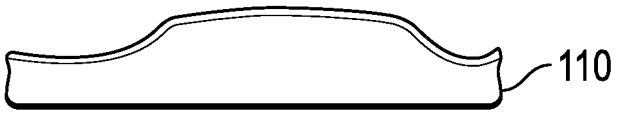
FIG. 23 is a forward view of an embodiment of the sole structure.

Furthermore, in some embodiments, when base component 110 and wedge component 120 are disposed against one another in an assembled sole structure 100 (see for example, FIGS. 11-13), some or all of the through-holes of the first set 510 formed in base component 110 can align directly with some or all of through-holes of the second set 520 formed in wedge component 120. In the figures, it can be seen that first set 510 and second set 520 form a substantially continuous set of openings through the thickness of sole structure 100. As used herein, holes are aligned with one another when they form a continuous hole or tunnel, such as by stacking the components that define the through-holes so that the through-holes at least partially overlap with one another. As shown in FIG. 21, the stacked through-holes can extend from the distal surface 511 of base component 110, through the thickness of base component 110, toward the proximal surface 513 of base component 110 (i.e., the first set 510), and continue to extend through the thickness of wedge component 120, from a distal surface 514 of the wedge component 120 to the proximal surface 516 of wedge component 120 (i.e., the second set 520). Thus, in one embodiment, a group of through-holes can extend through both base component 110 and wedge component 120.

As shown in FIGS. 5 and 7, at least one of the first set 510 and the second set 520 includes a forwardmost through-hole and a rearmost through hole. In the embodiment shown, each of the first set and the second set includes a forwardmost through-hole and a rearmost through-hole. For example, the first set 510 includes a forwardmost through-hole 510A and a rearmost through-hole 510B. The second set 520 includes a forwardmost through-hole 520A and a rearmost through-hole 520B. The forwardmost through-hole 510A is more elongate along the longitudinal axis 180 of the sole structure 100 than is the rearmost through-hole 510B. Additionally, the forwardmost through-hole 520A is more elongate along the longitudinal axis 180 of the sole structure 100 than is the rearmost through-hole 520B.

FIG. 7 also shows that through-holes of one or both of the first set 510 and the second set 520 are arranged in two or more rows. For example, the first set 510 includes rows 530, 531, 532, 533, 534, 535, 536, 537, and 538. The through-holes of each row 530, 531, 532, 533, 534, 535, 536, 537, and 538 are arranged transversely across a portion of the sole structure 100, which is generally the rearward base portion 312 of the base component 110. The rows 530, 531, 532, 533, 534, 535, 536, 537, and 538 are distributed along the longitudinal axis 180 with a forwardmost row 530 and a rearmost row 538. The through-holes of at least the first row 530 are offset transversely from the through-holes of at least the second row 531, such that a vertical plane P extending along the longitudinal axis 180 of the sole structure 100 and bisecting a through-hole of the first row 530 passes between two adjacent through-holes of the second row 531. The vertical plane P is shown in plan view in FIG. 7, and is represented with phantom lines in FIG. 8

Similarly, the second set 520 includes rows 540, 541, 542, 543, 544, 545, 546, 547, and 548. The through-holes of each row 540, 541, 542, 543, 544, 545, 546, 547, and 548 are arranged transversely across a portion of the sole structure 100, which is generally the central portion 320 of the wedge component 120. The rows 540, 541, 542, 543, 544, 545, 546, 547, and 548 are distributed along the longitudinal axis 180 with a forwardmost row 540 and a rearmost row 548. The through-holes of at least the first row 540 are offset transversely from the through-holes of at least the second row 541, such that the vertical plane P extending along the longitudinal axis 180 of the sole structure 100 and bisecting a through-hole of the first row 540 passes between two adjacent through-holes of the second row 541.

In addition, in some embodiments, one or more of the through-holes of the second set 520 extending through wedge component 120 can include a rim 525 extending around its perimeter at a distal end (i.e., bottommost end) of the through-hole. The rim 525 may also be referred to as a flange, as it is a projecting flat flange. In one embodiment, the rim 525 can be shaped and dimensioned to be received within the uppermost end (i.e., proximal end) of a corresponding through-hole of the first set of through-holes 510 formed in the base component 110. The rims 525 can facilitate alignment and engagement of wedge component 120 and base component 110 in some embodiments, and of the respective corresponding through-holes themselves (see for example FIGS. 7, 13, 21, 22, and 24). With reference to FIG. 21, a portion 525A of the rim 525 projects inwardly toward an axial center C of the through-hole of the second set 520, and a portion 525B of the rim 525 projects downwardly beyond the distal surface 514 of the wedge component 120. The portion 525B of the rim 525 that projects downwardly beyond the distal surface 514 of the wedge component 120 is dimensioned and shaped to be received within a proximal opening 526 of a corresponding through-hole of the first set 510.

Figure 8:
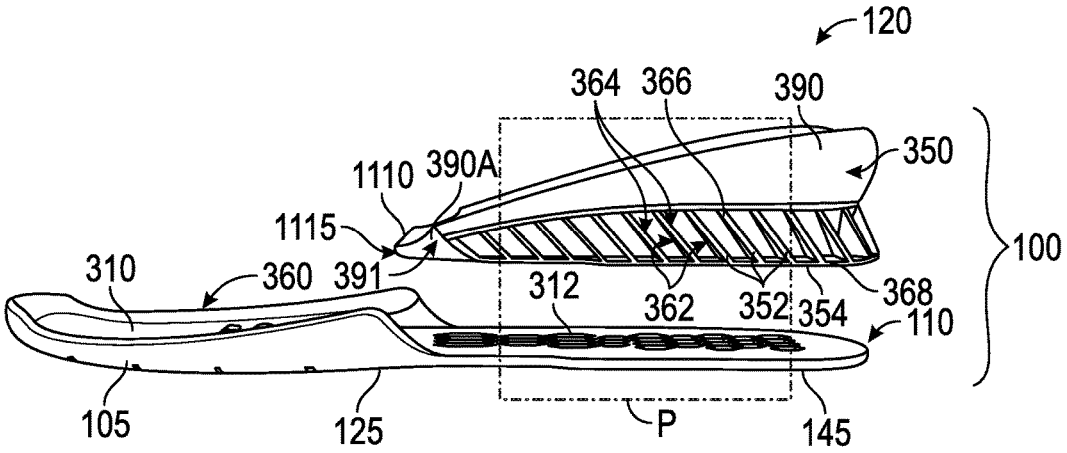
FIG. 8 is an exploded medial side view of an embodiment of the sole structure of FIG. 1.
Figure 9:
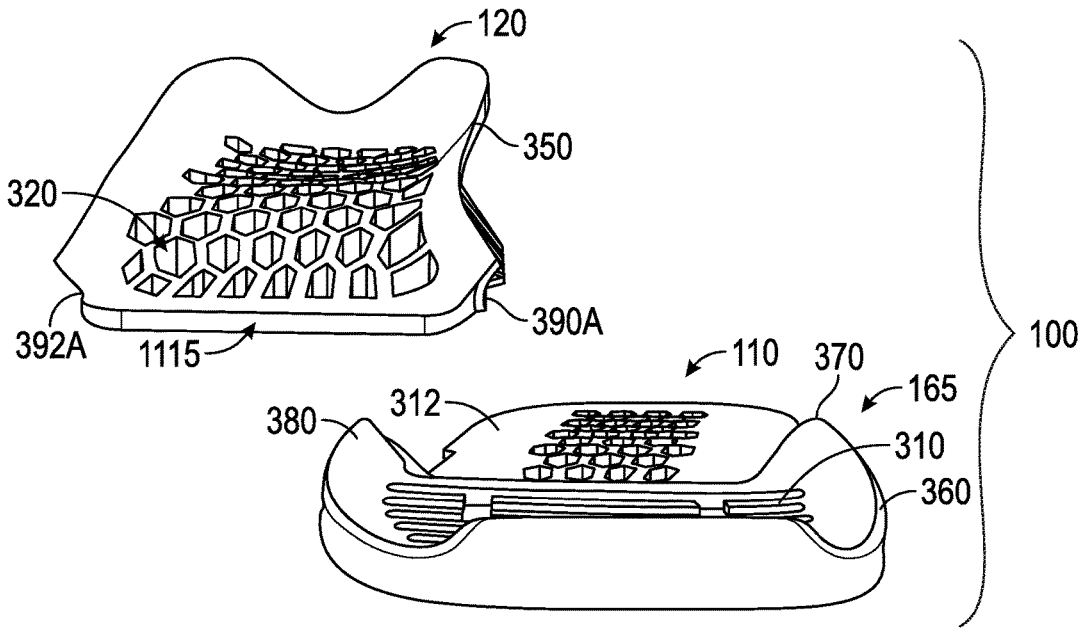
FIG. 9 is an exploded front view of an embodiment of the sole structure of FIG. 1.

With reference to FIGS. 6 and 8, the sole structure 100 may further comprise multiple support fins 352 arranged at each of the medial side 165 and the lateral side 185 of the wedge component 120. Only some of the support fins 352 are labelled with a reference number in the drawings. Each of the support fins 352 is coupled with an upper surface 353 of a substantially planar base portion 354 of the wedge component 120. Each support fin 352 further extends upwardly and inwardly toward a sloped distal surface 355, 356 of one or the other of the rearward lateral flange 392 and the rearward medial flange 390, respectively, as best shown in FIGS. 3 and 4.

At least one of the multiple support fins 352 has an exposed edge 357 that slopes downwardly and outwardly from proximate the sloped distal surface 355, 356 of one or the other of the rearward lateral flange 392 and the rearward medial flange 390 toward a peripheral edge 358 of the base portion 354 of the wedge component 120, as indicated in FIGS. 1 and 2. Each of the fins 352 thus forms an angular brace between the base portion 354 of the wedge component 120 and the upwardly and outwardly sloping sloped distal surface 355, 356 of the wedge component 120 adjacent the one or the other of the rearward lateral flange 392 and the rearward medial flange 390, as best shown in FIGS. 1 and 2. Additionally, each of the multiple support fins 352 may be substantially uniformly spaced apart from each other adjacent ones of the multiple support fins 352 along either or both of the lateral side 185 and the medial side 165 of the wedge component 120, as shown in the drawings. Moreover, the fins 352 may be configured so that a forward facing surface 362 of each of two or more of the multiple support fins 352 is parallel-planar relative to a rearward facing surface 364 of an adjacent one of the multiple support fins 352, as indicated in FIGS. 6 and 8.

Figure 16:
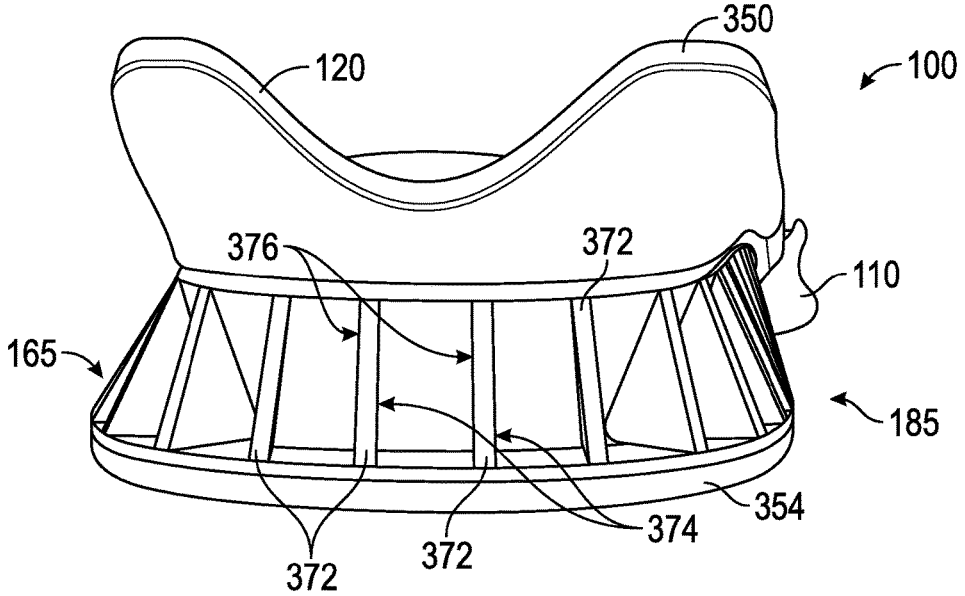
FIG. 16 is a rear view of an embodiment of the sole structure of FIG. 1.
Figure 17:
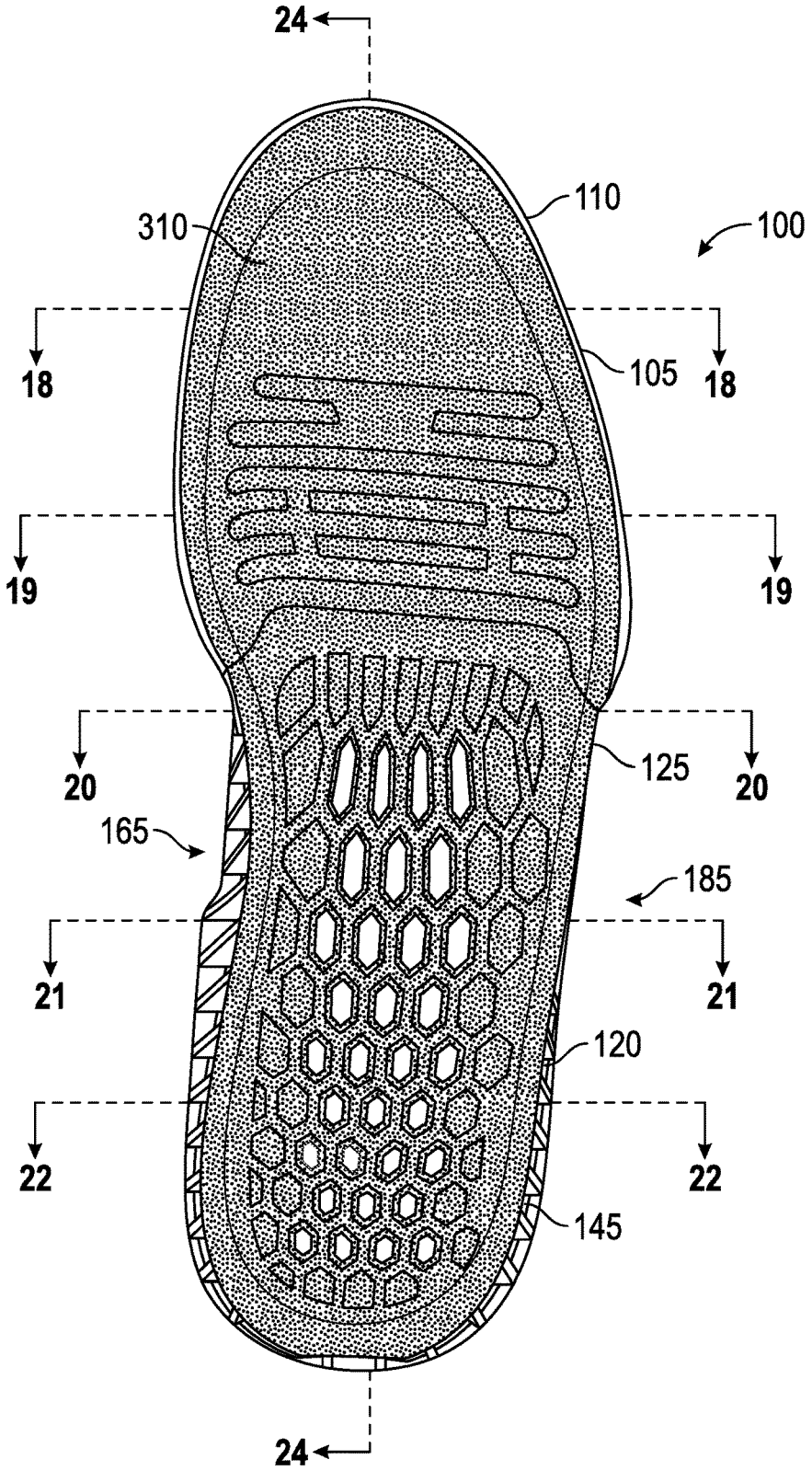
FIG. 17 is a top-down view of an embodiment of the sole structure of FIG. 1.

As also indicated in FIGS. 6 and 8, at least some of the multiple support fins 352 have an upper extent 366 and a lower extent 368, with the upper extent 366 located more forwardly than the lower extent 368 such that said at least some of the multiple support fins 352 angle forwardly. Additionally, the sole structure 100 may further comprise one or more additional support fins 372 disposed rearwardly of the multiple support fins 352 and proximate a heel portion 373 of the wedge component 120. As best shown in FIGS. 10 and 16, one or more of the additional support fins 372 may each have a planar lateral surface 374 and an opposing planar medial surface 376 both of which extend substantially vertically from the base portion 354 of the wedge component 120. The planar lateral surface 374 faces generally toward the lateral side 185, and the planar medial surface 376 faces more toward the medial side 165.

In different embodiments, a sole structure 100 is provided as part of an article of footwear to provide support along the base of the footwear. The sole structure 100 may function to provide traction and impact resistance, as well as general support for the foot. In the case of weightlifting, for example, the article of footwear, and in particular the sole components 110, 120, may include additional provisions that provide the necessary stability to perform various weightlifting moves.

For example, in some embodiments, base component 110 and/or wedge component 120 may be made of hard material. In particular, the material may be substantially non-deforming. For example, in some embodiments, the material may be a hard plastic. In other embodiments, various thermoplastics may be used. In one embodiment, the material may include thermoplastic polyurethane (TPU). In another embodiment, the material may include polyether block amide (such as but not limited to PEBAX®, a material available from Arkema Inc. in King of Prussia, Pa. USA). In some embodiments, a high abrasion rubber that can be mixed with other materials may be used for some portions. In other embodiments, different types of composite materials may be used. By using one of the materials disclosed herein, the sole structure 100 may be prevented from substantially deforming during a weightlifting maneuver and/or provide the necessary stability to the weightlifter. However, it should be understood that in some embodiments, the hardness or incompressibility of the material of base component 110 may differ from that of wedge component 120. For example, in one embodiment, the incompressibility of base component 110 may be less than that of wedge component 120. In other words, in some embodiments, base component 110 may be more compressible relative to wedge component 120.

Furthermore, the flexibility, elasticity, and/or bendability of the sole structure can vary in each component. For example, in some embodiments, a substantially non-flexible material can be used for base component 110 and/or wedge component 120. In one embodiment, however, base component 110 may be substantially more flexible or bendable than wedge component 120. In some embodiments, because wedge component 120 is disposed only over rearward base portion 312, this relative difference in flexibility can allow bending at the region of forward base portion where wedge component 120 and forward base portion 310 meet. During different athletic activities, particularly in some weightlifting activities, the ability to bend the foot along the ball of the foot can be of benefit, even while the material of the sole structure itself is substantially incompressible.

Furthermore, in some embodiments, there may be an insole (not shown) associated with sole structure 100. Generally, an insole may be made of a relatively lighter weight material that is disposed between a foot and sole structure 100. In addition, the insole can be made of a substantially deformable and/or compressible material. Thus, in one embodiment, base component 110 can have a first level of compressibility, wedge component 120 can have a second level of compressibility that is less than that of the first level of compressibility, and an insole can have a third level of compressibility that is greater than that of the first level of compressibility. However, other embodiments may not include an insole.

It should be understood that as noted earlier, the relative sizes and dimensions may differ from those illustrated in FIGS. 17-22 and 24-27 as shown and disclosed herein. In addition, in some other embodiments, either or both of wedge component 120 and base component 110 may be formed integrally as one component, but comprise the same or a substantially similar unitary configuration as the two individually described and depicted components when joined together. For example, in some embodiments, integral formation can be achieved via a single injection molding process, or sequential injection molding process wherein one of the components is first formed by molding with a first material, and then a second material is injection molded over the first component in the form of the second component, and positioned as described and depicted relative to the first component.

While various embodiments have been described, the description is intended to be exemplary, rather than limiting, and it will be apparent to those of ordinary skill in the art that many more embodiments and implementations are possible that are within the scope of the embodiments. Although many possible combinations of features are shown in the accompanying figures and discussed in this detailed description, many other combinations of the disclosed features are possible. Any feature of any embodiment may be used in combination with or substituted for any other feature or element in any other embodiment unless specifically restricted. Therefore, it will be understood that any of the features shown and/or discussed in the present disclosure may be implemented together in any suitable combination. Accordingly, the embodiments are not to be restricted except in light of the attached claims and their equivalents. Also, various modifications and changes may be made within the scope of the attached claims.

What is claimed is:

1. A sole structure for an article of footwear comprising:

a base component and a wedge component;

the base component having a forefoot region, a midfoot region, and a heel region, and including a forward base portion and a rearward base portion; wherein the forward base portion of the base component is thicker than the rearward base portion of the base component;

the forward base portion of the base component including a forward lateral flange and a forward medial flange;

the wedge component extending from the midfoot region to the heel region and including a forward portion having a rearward medial flange and a rearward lateral flange;

wherein the forward lateral flange of the base component abuts the rearward lateral flange of the wedge component, and the forward medial flange of the base component abuts the rearward medial flange of the wedge component; and wherein the wedge component includes a tongue, the base component includes a recessed intermediate portion extending between the forward lateral flange and the medial lateral flange, and the tongue overlies and abuts the recessed intermediate portion between the forward lateral flange and the rearward lateral flange.

2. The sole structure of claim 1, wherein the base component comprises a material of a first level of compressibility and the wedge component comprises a material of a second level of compressibility less than the first level of compressibility.

3. The sole structure of claim 1, wherein distal surfaces of each of the rearward lateral flange and the rearward medial flange of the wedge component slope downwardly and inwardly toward a central region of a base portion of the wedge component.

4. The sole structure of claim 3, further comprising multiple support fins arranged at each of the medial and lateral sides of the wedge component, wherein each of the multiple support fins is coupled with an upper surface of the base portion of the wedge component, and further extends upwardly and inwardly toward a sloped distal surface of one or the other of the rearward lateral flange and the rearward medial flange.

5. A sole structure for an article of footwear comprising:

a base component and a wedge component;

the base component having a forefoot region, a midfoot region, and a heel region, and including a forward base portion and a rearward base portion;

the forward base portion of the base component including a forward lateral flange and a forward medial flange;

the wedge component extending from the midfoot region to the heel region and including a forward portion having a rearward medial flange and a rearward lateral flange;

wherein the forward lateral flange of the base component abuts the rearward lateral flange of the wedge component;

wherein the forward medial flange of the base component abuts the rearward medial flange of the wedge component; and wherein the rearward base portion includes a first set of through-holes extending from a proximal surface of the base component to a distal surface of the base component, and the wedge component includes a second set of through-holes that are aligned with the first set of through-holes.

6. The sole structure of claim 5, wherein at least one of the first set of through-holes and the second set of through-holes includes a forwardmost through-hole and a rearmost through-hole; and wherein the forwardmost through-hole is more elongate along a longitudinal axis of the sole structure than is the rearmost through-hole.

7. The sole structure of claim 5, wherein through-holes of one or both of the first set of through-holes and the second set of through-holes are arranged in two or more rows, wherein the through-holes of each row of through-holes are arranged transversely across a portion of the sole structure, and the two or more rows are distributed along a longitudinal axis of the sole structure with a forwardmost row and a rearmost row.

8. The sole structure of claim 7, wherein the through-holes of at least a first row of the two or more rows of through-holes are offset transversely from the through-holes of at least a second row of the two or more rows of through-holes, such that a vertical plane extending along the longitudinal axis of the sole structure and bisecting a through-hole of the first row passes between two adjacent through-holes of the second row of through-holes.

9. The sole structure of claim 5, wherein the sole structure includes a rim extending around a perimeter of a through-hole of the second set of through-holes at a distalmost end of the through-hole; and wherein a portion of the rim projects inwardly toward an axial center of the through-hole.

10. The sole structure of claim 9, wherein a portion of the rim projects downwardly beyond a distal surface of the wedge component and is dimensioned and shaped to be received within a proximal opening of a corresponding through-hole of the first set of through-holes.

11. A sole structure for an article of footwear comprising:

a base component and a wedge component the base component having a forefoot region, a midfoot region, and a heel region, and including a forward base portion and a rearward base portion; the forward base portion of the base component including a forward lateral flange and a forward medial flange;

the wedge component extending from the midfoot region to the heel region and including a forward portion having a rearward medial flange and a rearward lateral flange;

wherein the forward lateral flange of the base component abuts the rearward lateral flange of the wedge component, and the forward medial flange of the base component abuts the rearward medial flange of the wedge component;

wherein distal surfaces of each of the rearward lateral flange and the rearward medial flange of the wedge component slope downwardly and inwardly toward a central region of a base portion of the wedge component;

the sole structure further comprising multiple support fins arranged at each of the medial and lateral sides of the wedge component, wherein each of the multiple support fins is coupled with an upper surface of the base portion of the wedge component, and further extends upwardly and inwardly toward a sloped distal surface of one or the other of the rearward lateral flange and the rearward medial flange; and wherein a forward facing surface of each of two or more of the multiple support fins is parallel-planar relative to a rearward facing surface of an adjacent one of the multiple support fins.

12. The sole structure of claim 11, wherein at least one of the multiple support fins has an exposed edge that slopes downwardly and outwardly from proximate the sloped distal surface of one or the other of the rearward lateral flange and the rearward medial flange toward a peripheral edge of the base portion of the wedge component, forming an angular brace between the base portion of the wedge component and an upwardly and outwardly sloping distal surface of the wedge component adjacent the one or the other of the rearward lateral flange and the rearward medial flange.

13. The sole structure of claim 11, wherein each of the multiple support fins is substantially uniformly spaced apart from each other adjacent ones of the multiple support fins along either or both of a lateral side and a medial side of the wedge component.

14. The sole structure of claim 11, wherein at least some of the multiple support fins have an upper extent and a lower extent, with the upper extent located more forwardly than the lower extent such that said at least some of the multiple support fins angle forwardly.

15. The sole structure of claim 11, further comprising one or more additional support fins disposed rearwardly of the multiple support fins and proximate a heel portion of the wedge component.

16. The sole structure of claim 15, wherein one or more of the additional support fins each have a planar lateral surface and an opposing planar medial surface both extending substantially vertically from the base portion of the wedge component.

17. An article of footwear comprising:

a base component having a forefoot region, a midfoot region, and a heel region; wherein the base component has a forward base portion and a rearward base portion, and a sloped proximal surface at which the base component decreases in height from the forward base portion to the rearward base portion;

a wedge component overlying the rearward base portion and tapering in height from a rear extent of the wedge component to a foremost extent of the wedge component; wherein the wedge component includes a tongue at the foremost extent, and wherein the tongue has a sloped distal surface that abuts and is coextensive with the sloped proximal surface of the base component.

18. The article of footwear of claim 17, wherein the base component has a medial shoulder and a lateral shoulder each of which protrudes inward adjacent the sloped proximal surface; and wherein the tongue is nested between the medial shoulder and the lateral shoulder.

* * * * *